US008151488B2

(12) United States Patent
Aveni

(10) Patent No.: US 8,151,488 B2
(45) Date of Patent: Apr. 10, 2012

(54) LINKED ARTICLES

(75) Inventor: Michael A. Aveni, Lake Oswego, OR (US)

(73) Assignee: NIKE, Inc., Beaverton, OR (US)

( * ) Notice: Subject to any disclaimer, the term of this patent is extended or adjusted under 35 U.S.C. 154(b) by 710 days.

(21) Appl. No.: 12/266,243

(22) Filed: Nov. 6, 2008

(65) Prior Publication Data

US 2010/0107443 A1 May 6, 2010

(51) Int. Cl.
*A43B 23/00* (2006.01)

(52) U.S. Cl. ..... 36/45; 36/9 R; 36/11.5

(58) Field of Classification Search ..... 36/45, 84, 36/87, 9 R; 223/44, 46; 28/143, 153
See application file for complete search history.

(56) References Cited

U.S. PATENT DOCUMENTS

| | | | | | |
|---|---|---|---|---|---|
| 261,282 | A | * | 7/1882 | Vedder | 52/663 |
| 726,166 | A | | 4/1903 | Irons | |
| 1,499,769 | A | | 7/1924 | Godefroy | |
| 1,577,648 | A | | 3/1926 | Mandalian | |
| 1,814,378 | A | | 7/1931 | Gilbertson et al. | |
| 1,992,856 | A | | 2/1935 | Blatz | |
| D102,946 | S | | 1/1937 | Furman | |
| 2,381,860 | A | | 8/1945 | Baggott | |
| 2,504,940 | A | | 4/1950 | Wallach | |
| 2,537,123 | A | * | 1/1951 | Dowling, Sr. | 36/59 R |
| 2,752,636 | A | * | 7/1956 | Morin | 264/242 |
| 2,829,402 | A | * | 4/1958 | Morin | 264/242 |
| 2,884,054 | A | | 4/1959 | Bryant | |
| 3,647,505 | A | * | 3/1972 | Bjorn-Larsen | 427/210 |
| 3,662,404 | A | | 5/1972 | Schinker | |
| 3,676,940 | A | * | 7/1972 | Shively | 36/8.1 |
| 3,718,996 | A | * | 3/1973 | Austin | 36/67 B |
| 3,949,495 | A | * | 4/1976 | Hollmann | 36/62 |
| 3,952,351 | A | * | 4/1976 | Gisbert | 441/64 |
| 3,977,458 | A | | 8/1976 | Kuen | |
| 4,232,458 | A | | 11/1980 | Bartels | |
| 4,265,032 | A | * | 5/1981 | Levine | 36/11.5 |
| 4,419,836 | A | * | 12/1983 | Wong | 36/11.5 |
| D281,456 | S | | 11/1985 | Swedarsky et al. | |
| D298,581 | S | | 11/1988 | Diaz | |
| 4,831,749 | A | | 5/1989 | Tsai | |
| 4,893,430 | A | | 1/1990 | Barfield | |
| 4,922,986 | A | * | 5/1990 | Leibowitz | 160/178.1 V |
| 5,096,335 | A | * | 3/1992 | Anderson et al. | 405/288 |

(Continued)

FOREIGN PATENT DOCUMENTS

| | | |
|---|---|---|
| EP | 0383685 | 8/1990 |

(Continued)

OTHER PUBLICATIONS http://cgi.ebay.com/J-CREW-Womens-Beaded-Thongs-Sandals-Shoes-8-US-SEXY_W0. retrieved from http://www.ebay.com/ on Oct. 15, 2007.

(Continued)

*Primary Examiner* — Darnell Jayne
*Assistant Examiner* — Kimberley S Wright
(74) *Attorney, Agent, or Firm* — Plumsea Law Group, LLC

(57) ABSTRACT

Linked articles and a method for customizing the linked articles are disclosed. The linked articles comprise a first link matrix and a second link matrix comprising a first portion of the article and a second portion of the article, respectively. The first link matrix consists essentially of links of a first material and the second link matrix consists essentially of links of a second material.

11 Claims, 18 Drawing Sheets

U.S. PATENT DOCUMENTS

| | | | | |
|---|---|---|---|---|
| 5,139,135 | A * | 8/1992 | Irwin et al. | 198/852 |
| 5,215,185 | A * | 6/1993 | Counter et al. | 198/853 |
| 5,494,734 | A | 2/1996 | Widders | |
| D375,398 | S | 11/1996 | Cetrangelo | |
| D384,205 | S | 9/1997 | Fink | |
| 5,768,802 | A * | 6/1998 | Bramani | 36/28 |
| D395,741 | S * | 7/1998 | Hatfield et al. | D2/953 |
| 5,964,340 | A | 10/1999 | Dolan | |
| D417,788 | S | 12/1999 | Gray | |
| D420,507 | S | 2/2000 | Fillio | |
| 6,401,364 | B1 | 6/2002 | Burt | |
| 6,589,891 | B1 | 7/2003 | Rast | |
| 6,763,611 | B1 * | 7/2004 | Fusco | 36/28 |
| D494,737 | S | 8/2004 | Schaefer | |
| 6,871,420 | B2 * | 3/2005 | Shikhashvili | 36/8.1 |
| D505,213 | S | 5/2005 | Kumar | |
| 6,986,269 | B2 * | 1/2006 | Dua | 66/177 |
| 6,991,141 | B2 | 1/2006 | Ciko et al. | |
| D517,297 | S | 3/2006 | Jones et al. | |
| D531,795 | S | 11/2006 | Gonzalez | |
| D533,983 | S | 12/2006 | Thornton | |
| 7,240,517 | B2 | 7/2007 | Barak | |
| 7,909,066 | B2 | 3/2011 | Wada | |
| 7,941,946 | B2 * | 5/2011 | Clancy et al. | 36/113 |
| 2002/0012784 | A1 * | 1/2002 | Norton et al. | 428/304.4 |
| 2004/0019950 | A1 | 2/2004 | Rast | |
| 2004/0134229 | A1 | 7/2004 | Oliver | |
| 2006/0059715 | A1 * | 3/2006 | Aveni | 36/45 |
| 2006/0107550 | A1 | 5/2006 | Caminiti | |
| 2006/0117600 | A1 * | 6/2006 | Greene | 36/9 R |
| 2006/0134351 | A1 * | 6/2006 | Greene et al. | 428/12 |
| 2006/0213936 | A1 | 9/2006 | Ciko et al. | |

FOREIGN PATENT DOCUMENTS

| | | |
|---|---|---|
| GB | 2180151 | 3/1987 |
| GB | 2430409 | 3/2007 |
| JP | 61000301 | 1/1986 |
| JP | 2004-073585 | 3/2004 |

OTHER PUBLICATIONS http://cgi.ebay.com/Antique-Fully-Beaded-Slippers-Beadwork-Shoes-Oriental_W0QQite. retrieved from http://www.ebay.com/ on Oct. 15, 2007.

http://cgi.ebay.com/Womens-bead-beaded-EARTH-SHOE-sandals-shoes-size-9-M_W0Q. retrieved from http://www.ebay.com/ on Oct. 15, 2007.

http://web.archive.org/web/20070630111741/http://www.abet-terbead.com/multi-hole-cart.html dated Jun. 30, 2007 retrieved from web.archive.org on Aug. 27, 2011.

* cited by examiner

LINKED ARTICLES

BACKGROUND

The present invention relates generally to articles and in particular to articles made of links.

Articles made of beads have been previously proposed. Oliver, (U.S. patent number 2004/0134229) teaches interconnected strings of beads. Oliver teaches prefabricated strings of beads that can be joined, or "snapped" together, perpendicularly, to form a fabric. Oliver further teaches that a double thickness fabric can be formed by joining together two layers of pre-fabricated strings. Oliver also lists several uses for the beaded fabric. In particular, Oliver lists bags, purses, fanny packs, cans and bottle holders, decorative packaging, Christmas stockings and other ornaments, wall hangings, banners, vests, skirts, tops, dancewear, headbands and hats, garter belts and other lingerie, bracelets, anklets, necklaces, collars and other jewelry, and fancy dress wear. Oliver also teaches the use of multi-colored beads for making various designs using the beaded fabrics. In one embodiment, Oliver teaches the use of a double thickness fabric to form a flag, making use of existing multi-colored strings of beads to form stripes, and ornamented with pairs of beads to give the impression of stars.

Blatz (U.S. Pat. No. 1,992,856) teaches a woven fabric with beads. Blatz teaches woven bodies or fabrics used in ladies' belts, ladies'handbags and other uses, which is formed, for the greater part, of metallically connected beads or balls. Blatz teaches using parallel strands consisting of metallic beads that are connected by metallic links to form warps of the fabric. Between adjacent strands are placed other warp strands of fibrous material so that the beads do not tend to fit in the spaces between the beads of the adjacent chains.

Tsai (U.S. Pat. No. 4,831,749) teaches an article of footwear having a single-layer ventilating and massaging insole. Tsai teaches an insole including a plurality of upper beads crossingly linked with a plurality of lower beads by a plurality of strut members. Tsai teaches that as a foot depresses the upper beads downwardly against the supporting lower beads, air is pumped upwards to ventilate a wearer's foot and also message the wearer's foot.

Rast (U.S. Pat. No. 6,589,891) teaches an abrasion resistant conformal beaded-matrix for use in safety garments. Rast teaches an article that is highly ventilated while providing abrasion protection for a wearer during a slide, for instance, that may occur during a fall from a motorcycle. Rast teaches a material including abrasion resistant, low sliding friction beads that are held within a matrix of high-tensile strength, abrasion-resistant cords. Rast teaches a rider's arm within a beaded matrix in sliding contact with a pavement surface. Rast teaches that a row of beads can be seen in contact with the pavement surface. As the rider slides the beads are retained above this platform of abrasive resistant, but low friction beads. Rast further teaches a trouser garment which incorporates an embodiment of the beaded matrix according to the invention.

SUMMARY

A linked article is disclosed. In one aspect, the invention provides an article configured to be worn, comprising: a first portion of the article comprising a first link matrix; a second portion of the article comprising a second link matrix; the first link matrix further comprising a first link set, the first link set comprising a substantial majority of the first link matrix; the second link matrix further comprising a second link set, the second link set comprising a substantial majority of the second link matrix; and where the first link set and the second link set are made of different materials.

In another aspect, the first link matrix further comprises a third link set.

In another aspect, the third link set is made of a different material than the first link set.

In another aspect, the first link matrix is associated with a first average rigidity.

In another aspect, the second link matrix is associated with a second average rigidity.

In another aspect, the first average rigidity is different than the second average rigidity.

In another aspect, the invention provides an article configured to be worn, comprising: a first portion of the article comprising a first link matrix; a second portion of the article comprising a second link matrix; and where the first link matrix consists essentially of a first material and the second link matrix consists essentially of a second material that is different from the first material.

In another aspect, the first portion is a sole portion of an article of footwear.

In another aspect, the second portion is an upper portion of the article of footwear.

In another aspect, the second material provides traction for the article.

In another aspect, the size of links comprising the first link matrix is different from the size of links comprising the second link matrix.

In another aspect, the first portion is a grasping portion of a glove.

In another aspect, the second portion is an outer portion of the glove.

In another aspect, the first material provides traction for the grasping portion.

In another aspect, links of the first link matrix are arranged differently than links of the second link matrix.

In another aspect, the invention provides a method of customizing an article configured to be worn, comprising: receiving a customized design for the article; associating the customized design with at least one link matrix; constructing the at least one link matrix according to the customized design; and assembling the article from the at least one link matrix.

In another aspect, the step of receiving a customized design for the article further comprises a step of providing a graphical interface for a customer to create the customized design.

In another aspect, the step of receiving a customized design for the article includes receiving at least one pre-selected material for a link.

In another aspect, the step of constructing the at least one link matrix includes a step of constructing a first link matrix and a second link matrix.

In another aspect, the first link matrix consists essentially of a different material than the second link matrix.

In another aspect, the invention provides an article configured to be worn, comprising: an upper portion of the article comprising a first link matrix; a threading of the first link matrix disposed at an instep portion of the article; and where a lace is inserted through a portion of the threading and wherein the lace is used to fasten the article.

In another aspect, a tube is disposed over the portion of the threading.

In another aspect, the tube forms an eyelet.

In another aspect, the invention provides an article configured to be worn, comprising: a link matrix comprising a first link set and a second link set; the first link set comprising a first material and the second link set comprising a second material; and where the first link set is configured to alternate with the second link set over a substantial majority of the link matrix.

In another aspect, the first link set and the second link set alternate in a herringbone pattern.

In another aspect, the link matrix is associated with a glove.

In another aspect, the link matrix is associated with an article of footwear.

In another aspect, the first material is plastic.

In another aspect, the second material is leather.

In another aspect, the invention provides an article of footwear configured to be worn, comprising: a first portion configured to fasten the article; a second portion configured to provide support to a portion of a body; and where the first portion comprises a first link matrix and wherein the second portion comprises a second link matrix.

In another aspect, the first link matrix is made of a different material than the second link matrix.

In another aspect, the first portion is a strap.

In another aspect, the article is a sandal.

In another aspect, the article is a glove.

Other systems, methods, features and advantages of the invention will be, or will become apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
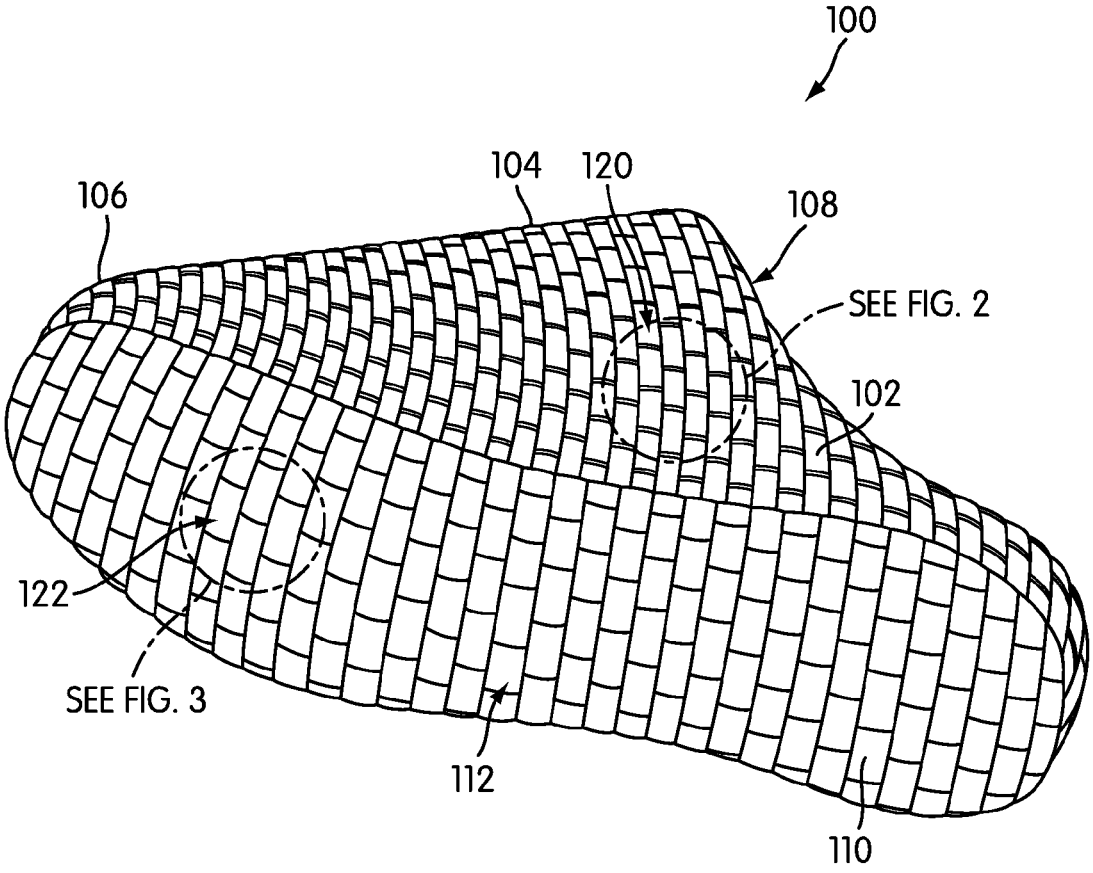
FIG. 1 is an isometric view of a preferred embodiment of a linked article.

FIG. 1 is an isometric exploded view of a preferred embodiment of article 100 that is configured to be worn. In this exemplary embodiment, article 100 is an article of footwear. However, it should be understood that the principles taught throughout this detailed description may be applied to additional articles as well. Generally, these principles could be applied to any article that can be worn. In some embodiments, the article may include one or more articulated portions that are configured to move. In other cases, the article may be configured to conform to portions of a wearer in a three dimensional manner. Examples of articles that are configured to be worn, include, but are not limited to, footwear, gloves, shirts, pants, socks, scarves, hats, jackets, as well as other articles. Other examples of articles include, but are not limited to, shin guards, knee pads, elbow pads, shoulder pads, as well as any other type of protective equipment. Additionally, in some embodiments, the article could be another type of article that is not configured to be worn, including, but not limited to, bags, purses, backpacks, as well as other articles that may not be worn.

In one exemplary embodiment, article 100 may be a slip-on type of article of footwear that does not require lacing. However, in other embodiments, article 100 could be any type of footwear, including, but not limited to, a running shoe, a basketball shoe, a high heel shoe, a boot, a high top shoe, a low top shoe, as well as other types of footwear. Additionally, while a single article is shown in the current embodiment, the same principles taught in this detailed description could be applied to a second, complementary article of footwear.

Article 100 preferably comprises upper portion 102. Upper portion 102 may be configured to receive a foot. In some embodiments, upper portion 102 may include instep portion 104. In a preferred embodiment, instep portion 104 may be closed. In other words, instep portion 104 does not require provisions for lacing. In other embodiments, however, instep portion 104 could include provisions for lacing.

Upper portion 102 may also include toe portion 106. In some embodiments, toe portion 106 may be continuously formed with instep portion 104. In other embodiments, toe portion 106 could be open. In a preferred embodiment, toe portion 106 may be closed and continuously connected with instep portion 104. Using this closed arrangement for instep portion 104 and toe portion 106, a majority of a foot may be received and covered within interior portion 108 of upper portion 102.

Although the current embodiment lacks a heel portion for upper portion 102, in other embodiments, upper portion 102 could include a heel portion. In some cases, the heel portion could be separated from the instep portion. In other cases, the heel portion could be joined with the instep portion via side portions of the article.

Article 100 also preferably includes sole portion 110. Preferably, sole portion 110 is configured to contact a ground surface. In particular, sole portion 110 may include lower surface 112 that is configured to contact the ground. Additionally, sole portion 110 may include an upper surface that is disposed opposite of lower surface 112.

In some embodiments, article 100 may be associated with additional provisions. For example, in some cases article 100 could include a midsole. In other cases, article 100 could include an insole. In still other cases, article 100 could include both a midsole and an insole. In this preferred embodiment, sole portion 110 is configured to attach directly to upper portion 102 without using a midsole or an insole. In other words, the upper surface of sole 110 is configured to contact a foot directly.

In previous designs, an article may be embellished with links for aesthetic purposes. Typically, such designs include sewing one or more links to a fabric structure in a portion of the upper. In some cases, the laces of an article of footwear may be decorated with links.

The current design provides articles made substantially entirely of links. In particular, the links used in the current design are structurally incorporated into the design of the article. Such designs may provide for a unique aesthetic appearance over traditional articles. Furthermore, various additional benefits can be provided. For example, using links to make an article may provide for increased breathability of the article. In some cases, using links to make an article may also provide for different material properties than would be accomplished using traditional materials. For example, an upper made from lightweight plastic links may have a different rigidity than an upper made from a synthetic material used for a traditional upper.

Referring to FIG. 1, article 100 is preferably made from a plurality of links. The term "link" as used throughout this detailed description and in the claims, refers to any object that includes a hole for receiving some kind of threading material. In some cases, a link may be a bead. However, the term link is not intended to be limited to an object of any particular size, shape, or material composition. Additionally, the term link may further include various types of links that are molded onto threaded materials during manufacturing and which are commonly known in the art.

In this embodiment, upper portion 102 preferably comprises first link matrix 120. Furthermore, sole portion 110 preferably comprises second link matrix 122. The term "link matrix", as used throughout this detailed description and in the claims, refers to any substantially continuous arrangement of links into a fabric-like matrix. Preferably, a link matrix may comprise a plurality of links that are connected using a threading material.

Generally, a threading material may be formed from any generally one-dimensional material. As utilized with respect to the present invention, the term "one-dimensional material" or variants thereof is intended to encompass generally elongate materials exhibiting a length that is substantially greater than a width and a thickness. Accordingly, suitable materials for threading materials include various filaments and yarns, for example. Filaments may be formed from a plurality of synthetic materials such as rayon, nylon, polyester, and polyacrylic, with silk being the primary, naturally-occurring exception. In addition, various engineering fibers, such as aramid fibers, para-aramid fibers, and carbon fibers, may be utilized. Yarns may be formed from at least one filament or a plurality of fibers. Whereas filaments have an indefinite length, fibers have a relatively short length and generally go through spinning or twisting processes to produce a yarn of suitable length. With regarding to yarns formed from filaments, these yarns may be formed from a single filament or a plurality of individual filaments grouped together. Yarns may also include separate filaments formed from different materials, or yarns may include filaments that are each formed from two or more different materials. Similar concepts also apply to yarns formed from fibers. Accordingly, filaments and yarns may have a variety of configurations exhibiting a length that is substantially greater than a width and a thickness. In addition to filaments and yarns, other one-dimensional materials may be utilized for threading material. Although one-dimensional materials will often have a cross-section where width and thickness are substantially equal (e.g., a round or square cross-section), some one-dimensional materials may have a width that is greater than a thickness (e.g., a rectangular cross-section). Despite the greater width, a material may be considered one-dimensional if a length of the material is substantially greater than a width and a thickness of the material.

In different embodiments, materials used for threads in a link matrix may vary. Suitable materials for threads for a link matrix include, but are not limited to, rayon, nylon, polyester, polyacrylic, silk, cotton, carbon, glass, aramids (e.g. para-aramid fibers and meta-aramid fibers), ultra high molecular weight polyethylene, and liquid crystal polymer. Additional engineering fibers can be used with threads for a link matrix, including glass fibers, boron fibers and silicon carbide fibers. Examples of commercially-available aramid fibers include KEVLAR, which is manufactured by E.I. duPont and Company, and TWARON, which is manufactured by Teijin Fibers Limited. Examples of commercially-available ultra high molecular weight polyethylene fibers include DYNEEMA, which is manufactured by Royal DSM N.V., and SPECTRA, which is manufactured by Honeywell. In addition, an example of a commercially-available liquid crystal polymer fiber is VECTRAN, which is manufactured by Kuraray America, Inc.

Different threading materials may be configured with different material characteristics. Examples of material properties that may be relevant in selecting specific materials for threads used in a link matrix include tensile strength, tensile modulus, density, flexibility, tenacity, resistance to abrasion, and resistance to degradation (e.g. from water, light, and chemicals). Preferably, a material for a thread used with a link matrix can be selected according to the desired material properties of the resulting thread. For example, a thread for a link matrix may be made from a material that is substantially elastic, such as nylon. This may allow a link matrix made with the thread to stretch. In other embodiments, however, a link matrix may be connected with a threading material that is substantially non-stretchable. Additionally, a threading material may be made with a strong material, such as Kevlar, to provide increased strength and durability to a link matrix.

In addition to material properties, the structural properties of various configurations of threads may be considered when selecting a particular configuration for a thread to be used with a link matrix. Examples of structural properties that may be relevant in selecting specific configurations for a thread include denier, number of poles, breaking force, twist, and the number of individual fibers or filaments, for example.

Based upon the structural properties and material properties discussed above, threads that include engineering fibers or other fibers may be utilized to enhance various aspects of a linked article. In other words, the properties of a thread may impart various properties to a linked article. For example, by selecting various types or combinations of threads, the threads may enhance the overall mass, performance, durability, comfort, aesthetic appear and manufacturing cost of threads and a linked article. Further examples of different types of threads, including different material and structural properties for various types of threads can be found in U.S. Pat. No. 7,870,682, currently U.S. patent application Ser. No. 11/838,011 entitled "Thread Configuration with Thread Structural Elements", filed on Aug. 13, 2007, the entirety of which is hereby incorporated by reference.

A link matrix may comprise any arrangement of links. In some embodiments, a link matrix could comprise a plurality of links configured in a generally two-dimensional arrangement. Such an arrangement may comprise a fabric-like layer of links that are connected using a threading material. In other embodiments, multiple fabric-like layers could be interconnected in a stacked configuration, providing a generally three-dimensional arrangement for the link matrix.

Figure 2:
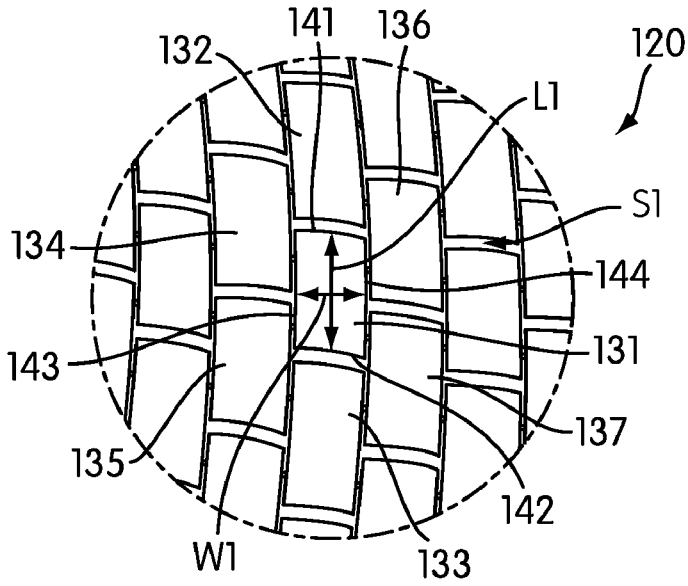
FIG. 2 is an enlarged view of a preferred embodiment of a first link matrix.

FIG. 2 is an enlarged view of a preferred embodiment of a portion of first link matrix 120. In some embodiments, first link matrix 120 may comprise multiple layers of links. In other embodiments, first link matrix 120 may comprise a single layer of links. In a preferred embodiment, first link matrix 120 may comprise a plurality of links configured in a generally two-dimensional or single layer, arrangement.

Generally, the links comprising first link matrix 120 may have any shape. Examples of possible shapes include, but are not limited to, spheres, cubes, discs, oblate spheroids, tetrahedrons, prisms, polyhedrons, any regular shapes, any irregular shapes, as well as any other kind of shape. In this exemplary embodiment, first link matrix 120 may comprise links with an approximately rectangular prism shape. In particular, first link matrix 120 may comprise links that present an approximately rectangular surface with rounded ends.

For example, in this embodiment, first link 131 of first link matrix 120 may have a generally rectangular shape. In particular, first link 131 may have a first length L1 that is greater than a first width W1. Furthermore, first link 131 has generally rounded edges. It should be understood that first link 131 also has a depth or thickness that is not visible in the Figures. In the preferred embodiment, the depth of first link 131 is less than length L1 and width W1.

In different embodiments, the length of one or more links could vary. Furthermore, the width of the links could vary. Also, the depth of the links could vary. By varying the length, width and/or depth of the links the overall shape and size of the links can be changed to accommodate various different provisions associated with different types of articles. Furthermore, although the current embodiment illustrates a plurality of links with substantially similar shapes, in other embodiments, each link can be associated with a different size. In some cases, the sizes of different links can vary dramatically over different portions of the article, or within the same link matrix.

In this exemplary embodiment, the remaining links comprising first link matrix 120 may have a substantially similar shape to first link 131. In other embodiments, some links comprising first link matrix 120 could have a different shape from first link matrix 120.

The links comprising first link matrix 120 may also be configured in any pattern. For example, in some embodiments, links comprising first link matrix 120 may be arranged in a simple grid, so that adjacent rows or columns of links are aligned with one another. In one exemplary embodiment, shown in the Figures, first link matrix 120 may comprise links arranged in a herringbone pattern. In this case, generally oblong links are aligned in an alternating manner. In still other embodiments, the links may be configured in any other arrangement known in the art.

In this exemplary embodiment, first link 131 may be surrounded by second link 132, third link 133, fourth link 134, fifth link 135, sixth link 136 and seventh link 137. In this case, first end 141 and second end 142 of first link 131 may be adjacent to second link 132 and third link 133, respectively. Likewise, first side 143 of first link 131 may be adjacent to fourth link 134 and fifth link 135. Additionally, second side 144 of first link 131 may be adjacent to sixth link 136 and seventh link 137. With this arrangement, first link 131, second link 132, third link 133, fourth link 134, fifth link 135, sixth link 136 and seventh link 137 comprise a portion of a general herringbone pattern for first link matrix 120. Preferably, each additional link in first link matrix 120 has a similar configuration with respect to adjacent links.

Generally, the spacing between links in a link matrix may vary. In some embodiments, the links may be densely packed together. In other embodiments, the links could be loosely spaced. By varying the spacing between adjacent links, some properties of the link matrix can be varied. In the exemplary embodiment shown in the Figures, the spacing between adjacent links is much smaller than the size of each link.

As previously discussed, the links comprising a link matrix may be attached using one or more threading materials. Generally, the links could be attached with the threading materials in any known manner. In some embodiments, each link may have a single hole for receiving threading material. In other embodiments, each link may include a plurality of holes for receiving multiple portions of a threading material.

Figure 3:
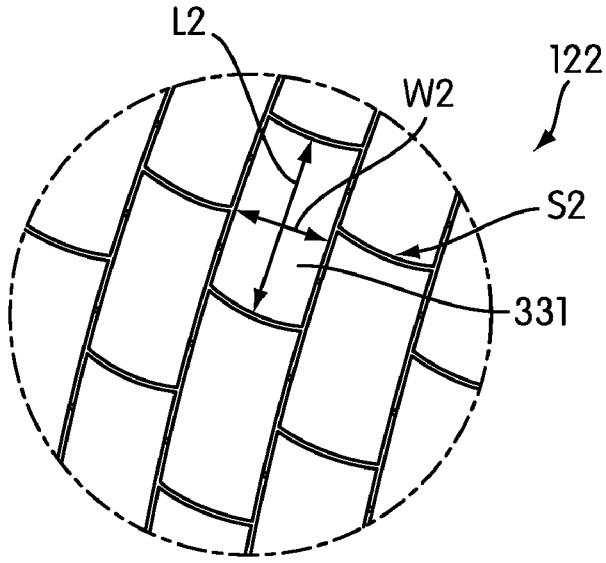
FIG. 3 is an enlarged view of a preferred embodiment of a second link matrix.

FIG. 3 is an enlarged view of a preferred embodiment of a portion of second link matrix 122 that is associated with sole portion 110. In some embodiments, second link matrix 122 may comprise multiple layers of links. In other embodiments, second link matrix 122 may comprise a single layer of links. In a preferred embodiment, second link matrix 122 may comprise a plurality of links configured in a generally two-dimensional or single layer, arrangement.

In some embodiments, an adhesive may be applied to one or more link matrices of a linked article. In particular, a polymer adhesive may be applied to a link matrix in order to fix the links of a link matrix in place. For example, a polymer adhesive could be applied to a link matrix in order to fix a particular pattern and prevent the links from displacing over time. Examples of polymer adhesives that may be used include, but are not limited to, elastomers, thermoplastic and thermosetting adhesives, as well as other types of polymer adhesives. For example, in some cases, polychloroprene, commonly known as Neoprene, can be used. Further examples of thermoplastic adhesives include, but are not limited to ethylene-vinyl acetate (EVA), Ionomers, polyamide-imide (PAI), as well as other thermoplastic adhesives.

Generally, the links comprising second link matrix 122 may have any shape, including the exemplary shapes listed above for first link matrix 120. In some embodiments, second link matrix 122 may include links having substantially similar shapes to the links of first link matrix 120. In other embodiments, second link matrix 122 may include links having different shapes than the links of first link matrix 120. In this preferred embodiment, second link matrix 122 also comprises links that have a generally rectangular prism shape.

For example, in this embodiment, first link 331 of second link matrix 122 may have a generally rectangular prism shape. In particular, first link 331 may have a second length L2 and a second width W2. The second length L2 is preferably greater than a second width W2. In this preferred embodiment, the remaining links comprising second link matrix 122 may have a substantially similar shape to first link 331.

The links comprising second link matrix 122 may also be configured in any pattern. For example, in some embodiments, links comprising second link matrix 122 may be arranged in a simple grid, so that adjacent rows or columns of links are aligned with one another. In one exemplary embodiment, shown in the Figures, second link matrix may comprise links arranged in a herringbone pattern. In this case, generally rectangular links are aligned in an alternating manner. In particular, the arrangement of links in second link matrix 122 may be substantially similar to the arrangement discussed for first link matrix 120. In still other embodiments, the links may be configured in another arrangement.

In some embodiments, the arrangement of links associated with different link matrices can vary dramatically in order to provide different provisions for different portions of an article. For example, in an alternative embodiment, links of second link matrix 122 could be arranged in a tight herringbone pattern while links of first link matrix 120 may be widely spaced apart in a regular checkered pattern in order to provide gaps in upper 102. Such an arrangement may provide for a very lightweight upper that increases airflow to a foot of a wearer while simultaneously providing a strong durable sole.

Generally, the sizes of the links comprising first link matrix 120 and second link matrix 122 may vary. In some embodiments, first link matrix 120 and second link matrix 122 may consist essentially of links of the same size. In other embodiments, first link matrix 120 and second link matrix 122 may consist essentially of links of different sizes. For example, in this exemplary embodiment, first link matrix 120 includes first link 131 with first length L1 and first width W1. Likewise, second link matrix 122 includes first link 331 with second length L2 and second width W2. In this case, the values of length L2 and width W2 may be greater than length L1 and width W1. In other words, first link 331 of second link matrix 122 may be larger than first link 131 of first link matrix 120. In this preferred embodiment, second link matrix 122 consists essentially of links of a similar size to first link 331. Likewise, first link matrix 120 preferably consists essentially of links of a similar size to first link 131.

Generally, the spacing of links comprising first link matrix 120 and second link matrix 122 may vary. In some embodiments, the links comprising first link matrix 120 may be spaced further apart than the links comprising second link matrix 122. For example, in the exemplary embodiment, the links comprising first link matrix 120 are separated by first spacing S1. Likewise, the links comprising second link matrix 122 are separated by second spacing S2. In this preferred embodiment, first spacing S1 is greater than second spacing S2. In other words, the links comprising second link matrix 122 are more densely packed than the links comprising first link matrix 120. With this arrangement, second link matrix 122 may provide for increased structural support for sole portion 110.

Typically, an article may be made of various types of materials. For example, an article of footwear may include different materials for a sole portion than for an upper portion. In some cases, an upper may be made from a lightweight and flexible material. Such materials include, but are not limited to, leather, natural fabrics, synthetic fabrics, lightweight plastics, as well as other materials. Furthermore, a sole may be made from more rigid materials that are configured to provide increased support and/or provide shock absorption. Examples of materials used in soles include, but are not limited to, rubbers, rigid plastics, dense foams, as well as other materials.

Generally, the materials used for links in different portions of article 100 may vary. In some embodiments, links associated with sole portion 110 may be made of the same material as links associated with upper portion 102. In other embodiments, links associated with sole portion 110 may be made of a different material than links associated with upper portion 102. In a preferred embodiment, sole portion 110 may include links made essentially of a first material that is different from a second material used in links comprising upper portion 102.

Generally, the links comprising each of these link matrices may be made from any materials used for links, including, but not limited to, glass, plastic, stone, bone, horn, ivory, metal, shell, pearl, coral, gemstones, polymer clay, metal clay, resin, synthetic minerals, wood, ceramic, fiber, paper and rubber. In some embodiments, links may be made from scrap or waste materials. In some cases, links may be made from recycled materials. In other embodiments, links may be made from other materials as well. Preferably, different materials are associated with different material characteristics. For example, some materials may be more rigid than other materials. Likewise, some materials may be smoother and may provide for more comfortable use of a linked article.

In this exemplary embodiment, first link matrix 120 may consist essentially of links made of a first material. Likewise, second link matrix 122 may consist essentially of links made of a second material. In a preferred embodiment, the first material may be different from the second material. For example, in the exemplary embodiment, first link matrix 120 may consist essentially of links made of plastic. Also, in this exemplary embodiment, second link matrix 122 may consist essentially of links made of rubber.

With this exemplary arrangement, upper portion 102 may be provided with some beneficial characteristics of plastic. In particular, using plastic links can allow for a lightweight design for upper portion 102. Furthermore, plastic links can provide a generally smooth contact surface for a foot to limit undesired frictional forces. This exemplary arrangement also provides sole portion 110 with some of beneficial characteristics of rubber. In particular, using rubber links on sole portion 110 allows for a ground engaging surface with substantial traction. Additionally, using rubber links may provide some shock absorption to article 100.

It should be understood that a link matrix need not be comprised of a single type of link. For example, some link matrices could include links of differing shapes. Likewise, some link matrices could include a majority of links made of one material, and a few links made of a second material. In this exemplary embodiment, first link matrix 120 and second link matrix 122 preferably consist essentially of plastic links and rubber links, respectively. However, in another embodiment, first link matrix 120 could comprise plastic links alternating with leather links, to provide additional aesthetic appeal. Likewise, in another embodiment, second link matrix 122 could comprise rubber links alternating with foam links to increase shock absorption of sole portion 110.

Figure 4:
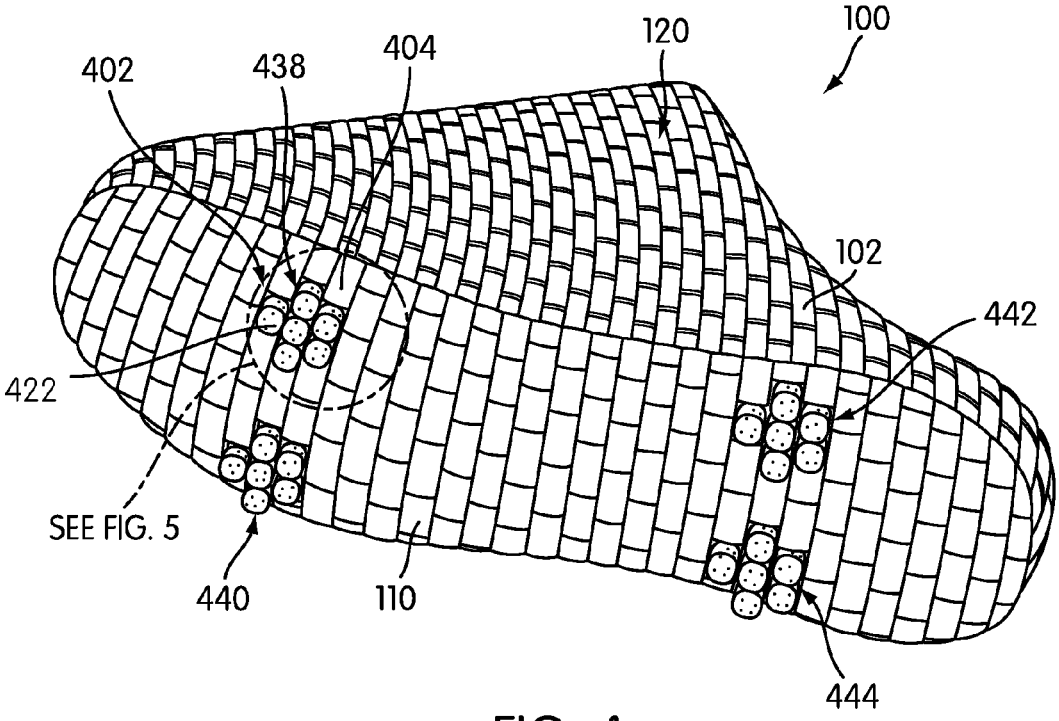
FIG. 4 is an isometric view of a preferred embodiment of a linked article.
Figure 5:
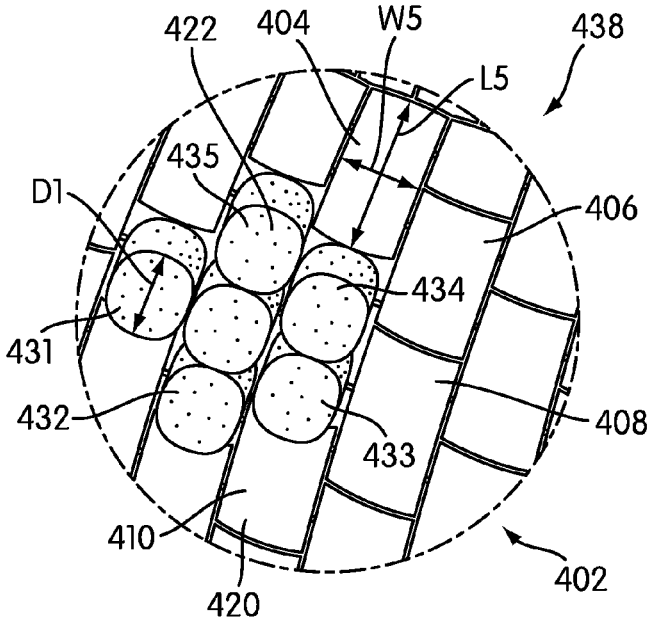
FIG. 5 is an enlarged view of a preferred embodiment of a link matrix.
Figure 6:
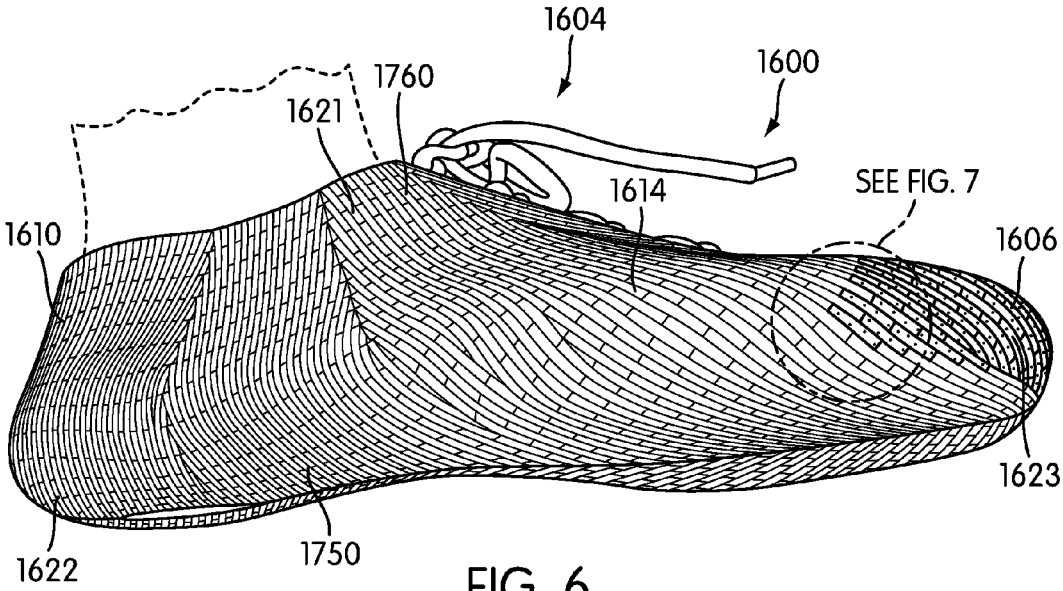
FIG. 6 is an isometric view of a preferred embodiment of a linked article.

FIGS. 4 and 5 illustrate an alternative embodiment of article 100. Referring to FIG. 4, article 100 includes upper portion 102 and sole portion 110. As in the previous embodiment, upper portion 102 is made from first link matrix 120. Furthermore, first link matrix 120 consists essentially of links made of a first material.

In this alternative embodiment, sole portion 110 may be made of third link matrix 402. In some embodiments, third link matrix 402 may include more than one type of link. In some embodiments, third link matrix 402 may include links with different sizes and shapes. Additionally, in some embodiments, third link matrix 402 may include links of different materials.

Referring to FIG. 5, an enlarged view of first region 438 of sole portion 110, third link matrix 402 preferably includes first link set 420 and second link set 422. In this case, first link set 420 preferably includes first link 404, second link 406, third link 408, fourth link 410, as well as additional links seen in the illustration. First link 404, second link 406, third link 408 and fourth link 410 preferably have a substantially similar shape and size. For example, first link 404 preferably has a generally rectangular prism shape. In particular, first link 404 preferably has length L5 and width W5. The remaining links comprising first link set 420 preferably have a similar size and shape to first link 404.

In this embodiment, second link set 422 includes a first link 431, second link 432, third link 433, fourth link 434 and fifth link 435. Each of the links comprising second link set 422 preferably have a substantially similar shape and size. For example, first link 431 preferably has an approximately cylindrical shape. In particular, first link 431 may have a diameter D1. Additionally, in some embodiments, first link 431 projects outwards from sole portion 110. In a preferred embodiment, second link 432, third link 433, fourth link 434 and fifth link 435 have substantially similar shapes to first link 431 of second link set 422.

In some embodiments, the links comprising second link set 422 may be arranged in a localized region of sole 110. In this exemplary embodiment, the links comprising second link set 422 may be arranged in a generally circular manner. In some cases, this localized arrangement of the links of second link set 422 is intended to provide cleat like support for sole portion 110.

Referring back to FIG. 4, second link set 422 may include additional links as well. In this exemplary embodiment, second link set 422 may comprise a plurality of links disposed in second region 440, third region 442 and fourth region 444 of sole portion 110. Preferably, groups of links from second link set 422 are configured in a circular-like arrangement in second region 440, third region 442 and fourth region 444. This arrangement may be similar to the arrangement of first link 431, second link 432, third link 433, fourth link 434 and fifth link 435 in first region 438. With this arrangement, the links comprising second link set 422 may provide for cleat-like structures at first region 438, second region 440, third region 442 and fourth region 444.

In some embodiments, the links comprising first link set 420 and the links comprising second link set 422 could be made of the same material. In other embodiments, the links comprising first link set 420 and the links comprising second link set 422 could be made of a different material. In this exemplary embodiment, the links comprising first link set 420 may be made of a second material, as previously discussed. Furthermore, the links comprising second link set 422 may be made of a third material. In this case, the second material may be different from the third material. For example, the second material may be a first type of rubber and the third material may be made of a second type of rubber with a greater density than the first type of rubber. With this arrangement, second link set 422 may be provided with a stiffer material so that the links of second link set 422 can penetrate into the ground to increase traction.

In some embodiments, each link matrix may have an average rigidity. The average rigidity of a link matrix could be determined according to various factors, including link sizes, link materials and link arrangements, as well as other factors. It should be understood that the average rigidity of a link matrix could be different from the rigidity of individual links comprising the link matrix. In particular, the shapes, sizes and arrangement of the links within the link matrix also contribute to the average rigidity of the link matrix.

In some cases, first link matrix 120 may have a first rigidity. Also, second link matrix 122 may have a second rigidity. In this exemplary embodiment, the first rigidity of first link matrix 120 is less than the second rigidity of second link matrix 122. With this arrangement, sole portion 110 may have a different average rigidity than upper portion 102. For example, in some cases, sole portion 110 could be stiffer than upper portion 102, to allow for increased support for a bottom of a foot.

In some embodiments, a sole portion and an upper portion may be continuously formed to create an article that fits a foot closely. FIGS. 6-9 illustrate a preferred embodiment of article 1600. In this preferred embodiment, article 1600 is configured with upper portion 1760 that is continuously formed with sole portion 1750. With this arrangement, upper portion 1760 and sole portion 1750 may wrap around a foot inserted into article 1600. In particular, this configuration may allow article 1600 to conform to the contour of a sole and an upper of a foot and provide increased flexibility.

In this embodiment, article 1600 also includes heel portion 1610 and toe portion 1606. Preferably, heel portion 1610 may provide structure to support a heel of a wearer. In addition, toe portion 1606 may protect toes of a wearer. In some embodiments, article 1600 may be associated with additional provisions, including, but not limited to, a midsole and insole.

In this embodiment, upper portion 1760 and sole portion 1750 of article 1600 are made from first link matrix 1621. Furthermore, heel portion 1610 may be associated with second link matrix 1622. Similarly, toe portion 1606 comprises third link matrix 1623. With this arrangement, first link matrix 1621 may be joined with second link matrix 1622 as well as third link matrix 1623 to form article of footwear 1600.

In some embodiments, an article of footwear may include link matrices comprised of links oriented in different directions. The term "link orientation", as used throughout this detailed description and in the claims, refers to a directional layout of links with respect to an article of footwear. Generally, links may be oriented in any direction within a link matrix forming an article of footwear. In some cases, links may be oriented to follow a longitudinal axis that is disposed between a heel portion and a toe portion of an article. In other cases, links may be arranged to agree with latitudinal axes disposed across a width of an article of footwear. In still other cases, links may be oriented to conform with vertical axes disposed from a sole to an upper of an article. By including link matrices with links oriented in different directions, the aesthetic appeal of an article of footwear may be enhanced. Furthermore, the structure of an article may be fine tuned by link matrices with links oriented in different directions.

In this embodiment, third link matrix 1623 has a slightly different orientation from first link matrix 1621. Additionally, third link matrix 1623 has a slightly different orientation from second matrix 1622. By using slightly different orientations, heel region 1610 and toe region 1606 can be provided with slightly different structural characteristics.

As discussed previously, an article may include links made from multiple materials with different material characteristics. In this preferred embodiment, second link matrix 1622 is constructed from a soft material such as a natural fiber. The soft material comprising second link matrix 1622 preferably accommodates the snug fit of article 1600 and reduces uncomfortable rubbing on a heel of a wearer. In contrast, third link matrix 1623 may be constructed of a stronger and more durable material such as rubber. With this arrangement, third link matrix may provide rigidity and durability to toe region 1606.

In addition to functional purposes, materials may also be selected for aesthetic purposes. In this embodiment, first link matrix 1621 comprises of links made of leather. This may provide a pleasing rough appearance for a portion of article 1600. In contrast, third link matrix 1623 could comprise rubber links with a generally smooth outer surface.

Figure 7:
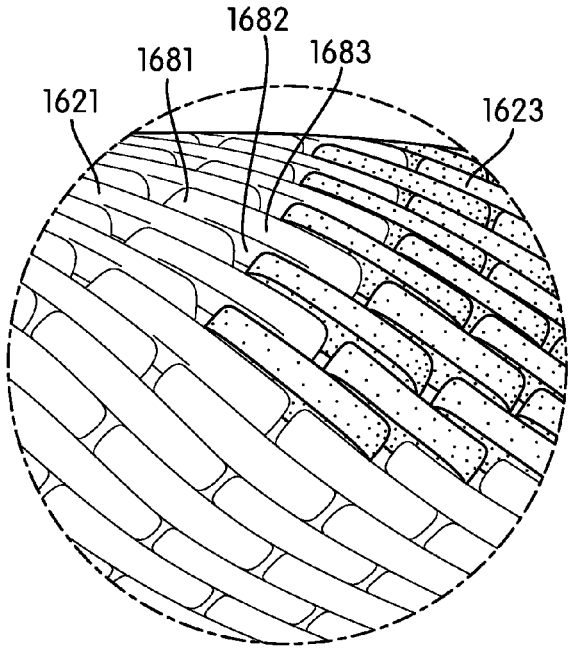
FIG. 7 is an enlarged view of a preferred embodiment of a first link matrix and a third link matrix.

Referring to FIG. 7, an enlarged view of a portion of first link matrix 1621 and third link matrix 1623, the rough surface of first link matrix 1621 is juxtaposed with the smooth surface of third link matrix 1623. Preferably, this juxtaposition of different materials with different textures enhances the appearance of article 1600. By including multiple materials in first link matrix 1621, second link matrix 1622 and third link matrix 1623, the appearance of article 1600 as well as the function of different portions of article 1600 may be fine tuned.

In some embodiments, a link matrix may present an outer surface that is different from one or more surfaces of the link that are generally hidden from view during use. In the current embodiment, seen in FIG. 7, first link matrix 1621 includes first link 1681. Preferably, first link 1681 includes inner surface 1682 that is configured to face adjacent links within first link matrix 1621. First link 1681 may also include outer surface 1683 that is configured to face outwards. Generally, inner surface 1682 may not be visible during use of article 1600 while outer surface 1683 is visible during use. In some cases, inner surface 1682 could be scuffed or scratched without detracting from the overall aesthetic appeal of first link matrix 1621. Likewise, outer surface 1683 could be smooth and free of scratches, scuffs or other marks. This arrangement could allow the use of materials with imperfections so long as the imperfections are disposed on surfaces that are not oriented outwards on article 1600 and easily visible. In some cases, this can help increase the usability of materials that would otherwise be thrown away because of these imperfections.

Figure 8:
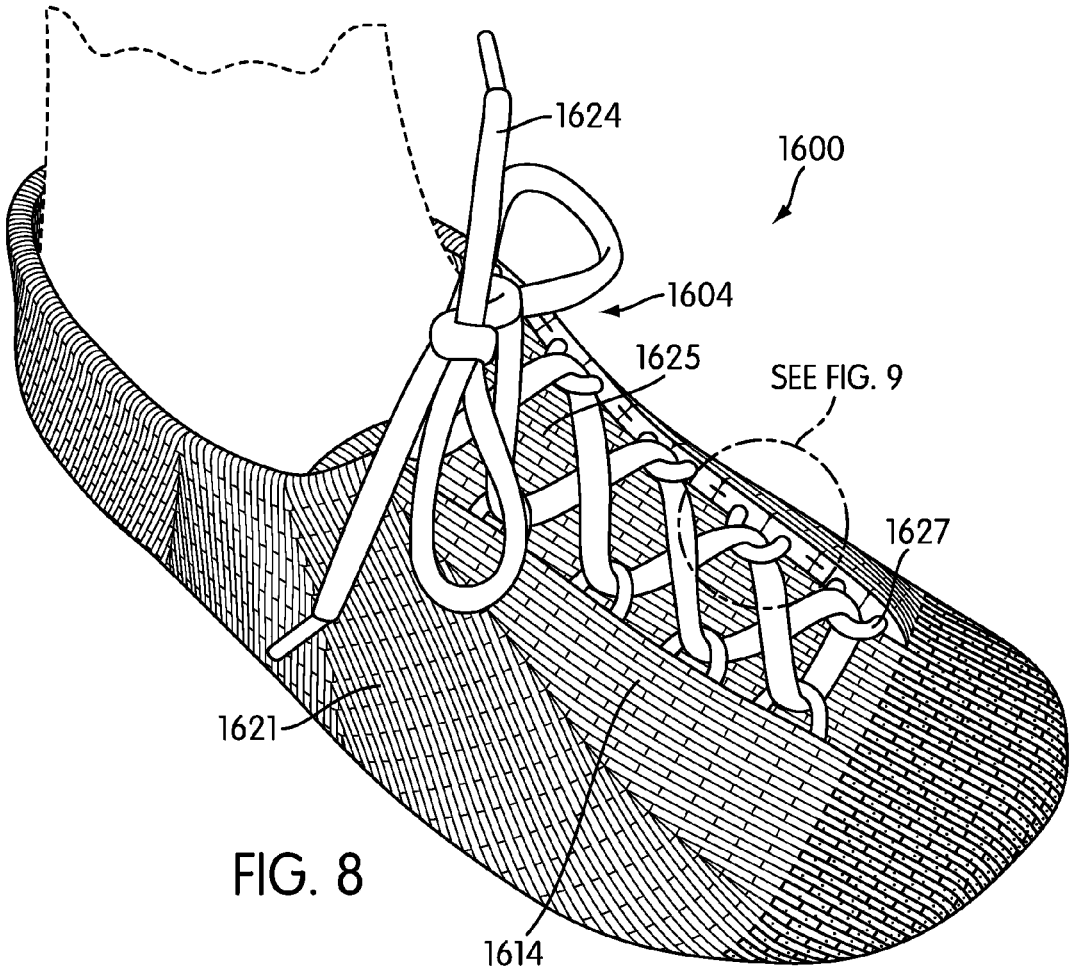
FIG. 8 is a top view of a preferred embodiment of a linked article.

Referring to FIG. 8, article 1600 includes provisions for tightening around the foot of a wearer. In some embodiments, article 1600 may be a slip-on type of article of footwear that does not require lacing. In other embodiments, article 1600 may be associated with a fastening system, including, but not limited to laces, straps, zippers, hook and loop fasteners, or other types of fastening systems. In some cases, article 1600 may include a tongue to protect an instep of a sole from unwanted friction from a fastening system. In this preferred embodiment, article 1600 includes fastening system 1604 configured with tongue 1625.

Preferably, fastening system 1604 is disposed on instep portion 1614. Specifically, fastening system 1604 is disposed over tongue 1625. In some embodiments, tongue 1625 may comprise a separate link matrix. In this preferred embodiment, tongue 1625 may be part of first link matrix 1621.

In this embodiment, article 1600 may be fastened by pulling lace 1624. Generally, lace 1624 may be secured to article 1600 in any manner. In some embodiments, gaps within first link matrix 1621 may include provisions receive lace 1624. In this preferred embodiment, lace 1624 may be secured to article 1600 by tubes 1627 disposed proximate to first link matrix 1621.

Generally, tubes 1627 may be anchored to first link matrix 1621 in any manner known in the art. In some embodiments, tubes 1627 may be attached to links within first link matrix 1621 by welding or cementing. In other embodiments, tubes 1627 may be anchored to links within first link matrix 1621 by knotting. In a preferred embodiment, tubes 1627 may be hollow and configured to receive threading from first link matrix 1621.

Figure 9:
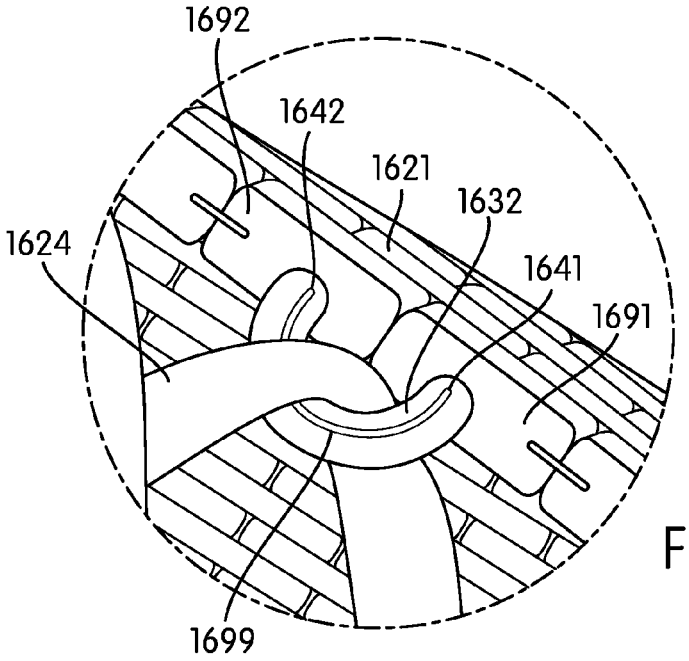
FIG. 9 is a enlarged view of a preferred embodiment of a portion of a fastening system.

Referring to FIG. 9, an enlarged view of second tube 1632 of tubes 1627, lace 1624 may be laced through second tube 1632 in order to secure lace 1624 to article of footwear 1600. In this embodiment, second tube 1632 is a hollow tube configured to receive a portion of threading 1699 from first link matrix 1621. In particular, second tube 1632 is configured to cover portion of threading 1699 from first end 1641 to second end 1642 of threading 1699, associated with first link 1691 and second link 1692, respectively. Other tubes comprising tubes 1627 may be anchored to first link matrix 1621 in a substantially similar manner. With this arrangement, lace 1624 may be laced through tubes 1627 and secured to article of footwear 1600. Furthermore, lace 1624 may be pulled to tighten article of footwear 1600, and first link matrix 1621 in particular, around a foot.

Generally, tubes 1627 or any type of receiver for lace 1624 may be constructed from any material including, but not limited to, materials suitable for links or threading materials. In some embodiments, tubes 1627 may constructed from the same material as first link matrix 1621. In this embodiment, tubes 1627 are constructed of a durable plastic.

Figure 10:
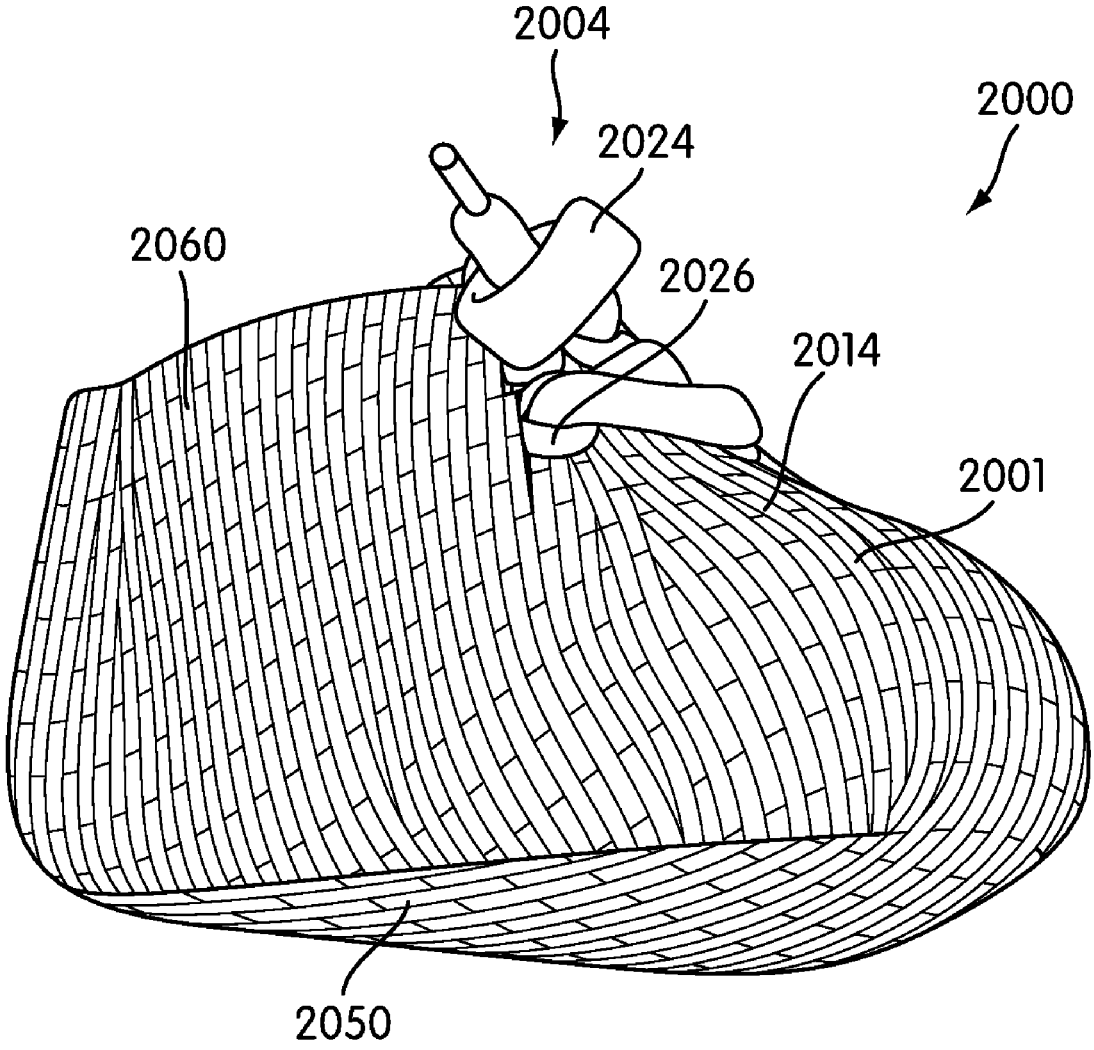
FIG. 10 is an isometric view of a preferred embodiment of a linked article configured for an infant.

It is also possible to construct an article of footwear comprised of link matrices for an infant or toddler. In particular, a flexible and breathable article of footwear comprised of link matrices may be desirable for infants or toddlers with growing feet and emergent walking skills. FIG. 10 illustrates a preferred embodiment of article of footwear 2000 configured for an infant.

In this embodiment, article of footwear 2000 includes upper portion 2060 and sole portion 2050. Furthermore, upper portion 2060 and sole portion 2050 may be continuously formed. In addition, upper portion 2060 may be configured to extend relatively high on an upper portion of a foot inserted within article of footwear 2000. With this arrangement, upper portion 2060 may envelop an ankle of an infant. Typically, this configuration may assist the securing of article of footwear 2000 to a foot of an infant.

In this embodiment, article of footwear 2000 includes first link matrix 2001. In this embodiment, sole portion 2050 and upper portion 2060 may both be associated with first link matrix 2001. However, in other embodiments, article of footwear 2000 may comprise multiple link matrices. Preferably, first link matrix 2001 may provide a comfortable continuous surface for an infant foot disposed within article of footwear 2000.

In some embodiments, article of footwear 2000 may be secured to a foot of an infant without a fastening system. In some cases, a portion of upper 2060 may include an elastic ankle band to secure a foot within article of footwear 2000. In other embodiments, article of footwear 2000 may be associated with a fastening system, including, but not limited to laces, straps, zippers or other types of fastening systems. In still other embodiments, article of footwear 200 may be associated with a hook and loop fastening system, such as Velcro. In this preferred embodiment, article of footwear 2000 includes fastening system 2004 configured with lace 2024.

Fastening system 2004 may be disposed on instep portion 2014. Using this configuration, instep portion 2014 may be open and configured to close via tightening of lace 2024 of fastening system 2004.

Generally, lace 2024 may be secured to article of footwear 2000 in any manner. In this embodiment, lace 2024 is secured through gaps in first link matrix 2001. In particular, lace 2024 is secured through gaps in first link matrix 2001 that are reinforced with eyelets 2026. Preferably, eyelets 2026 are constructed of a durable material and attached to gaps within first link matrix 2001. This arrangement preferably provides a secure method of attaching lace 2024 to article of footwear 2000. With this arrangement, lace 2024 may be pulled to tighten instep portion 2014 around a foot of an infant thereby securing article of footwear 2000 on a foot of an infant.

Figure 11:
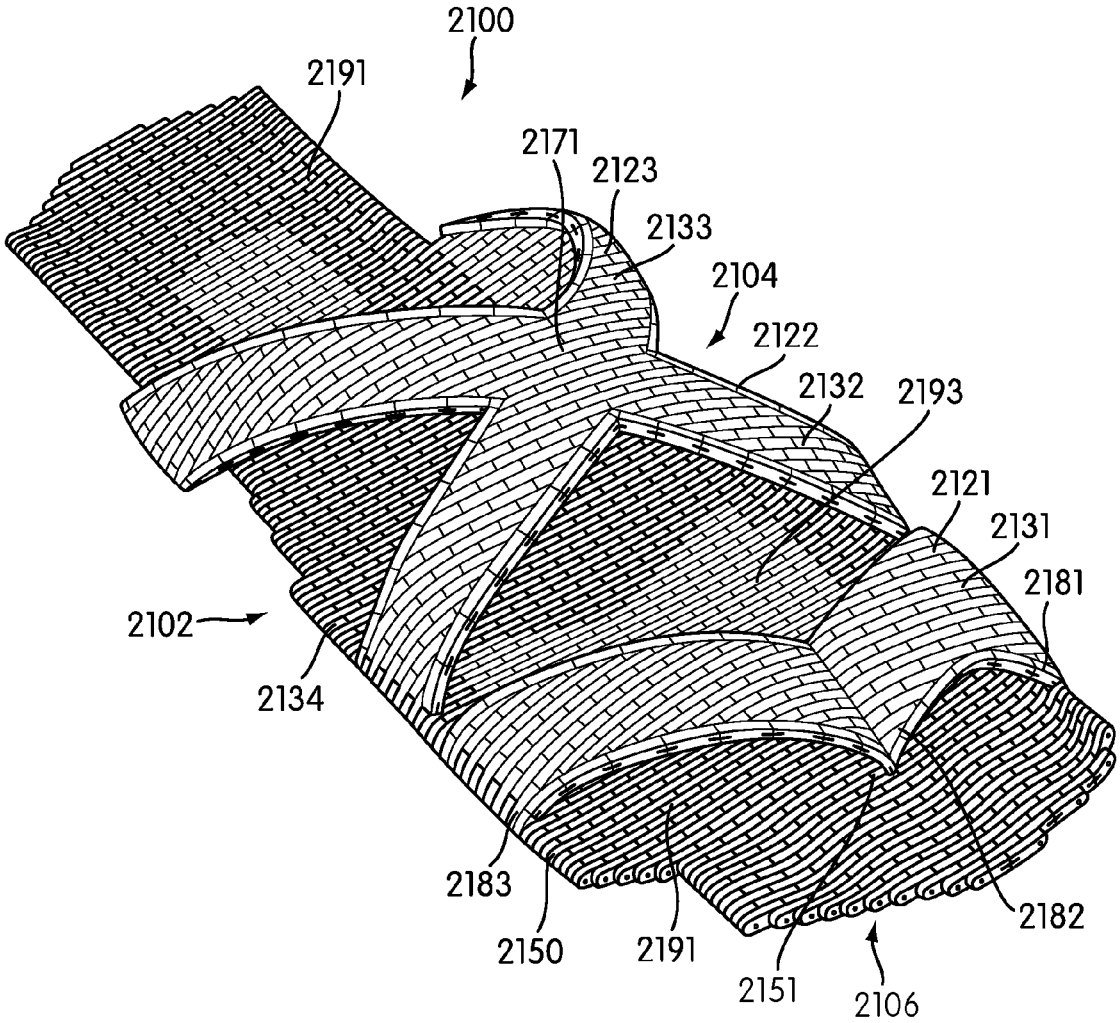
FIG. 11 is an isometric view of a preferred embodiment of a linked article configured as a sandal.
Figure 12:
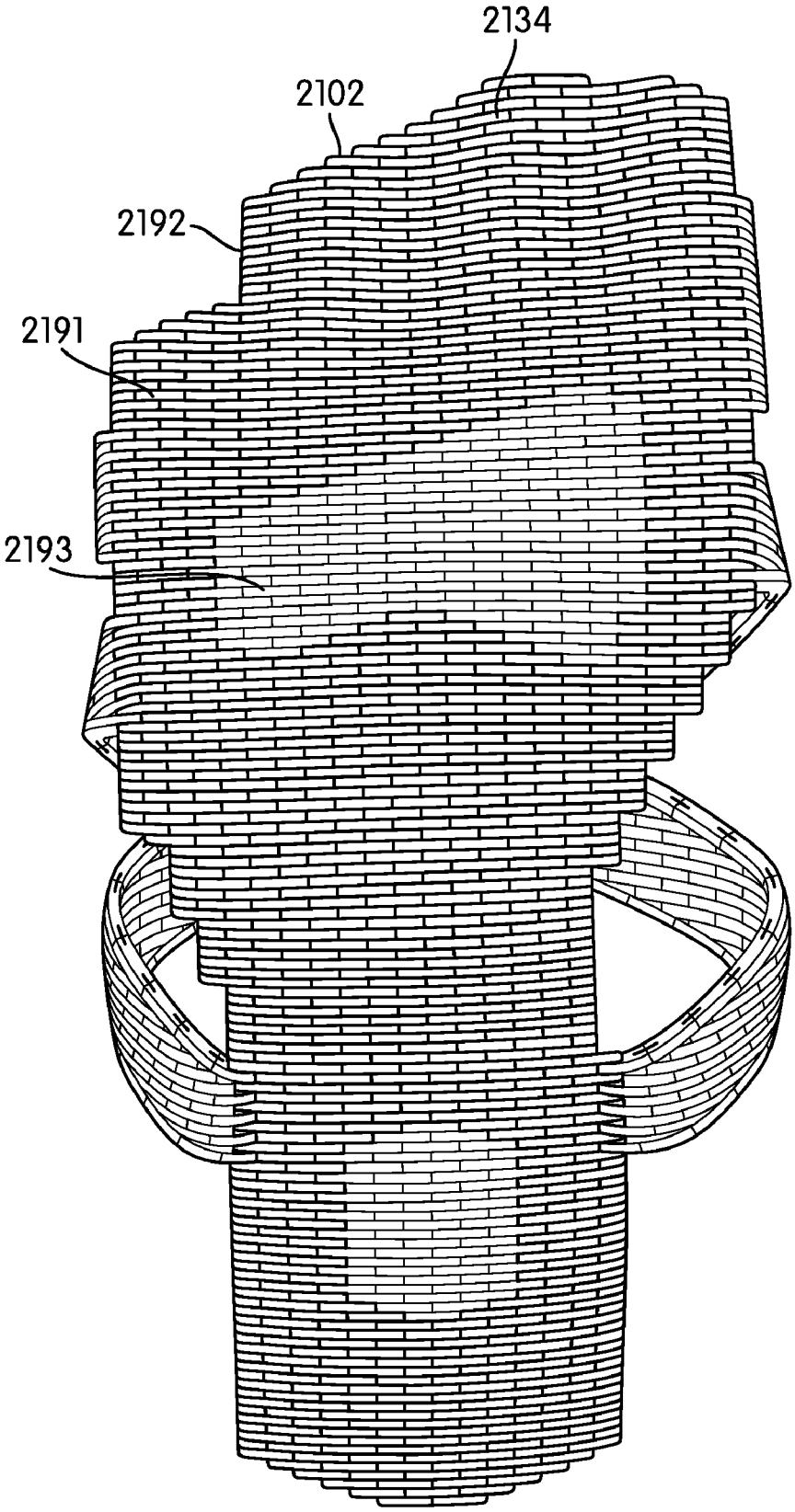
FIG. 12 is a bottom view of a preferred embodiment of a linked article configured as a sandal.

In some embodiments, an article of footwear configured as a sandal may also be comprised of link matrices. A sandal comprised of link matrices may provide durability as well as an aesthetically desirable appearance. FIGS. 11-12 illustrates a preferred embodiment of article of footwear 2100 configured as a flip flop.

In this embodiment, article of footwear 2100 includes straps portion 2104 and sole portion 2102. Generally, straps portion 2104 may include any number of straps. In this embodiment, straps portion 2104 includes first strap 2121, second strap 2122 and third strap 2123. Preferably, straps portion 2104 is configured to hold a foot of a wearer against upper surface 2191 of sole portion 2102 of article of footwear 2100.

Generally, first strap 2121, second strap 2122, and third strap 2123 may be configured in any manner to hold a foot of a wearer against sole portion 2102. In this embodiment, first strap 2121 is disposed near toe portion 2106 of sole portion 2102. In particular, first strap 2121 includes first fixed end 2181, central region 2182 and second fixed end 2183. First fixed end 2181 and second fixed end 2183 may be attached to sole portion 2102 at periphery 2150. In this manner, first strap 2121 may be attached to sole portion 2102. In addition, central region 2182 of first strap 2121 may be attached to central portion 2151 of toe portion 2106. With this arrangement, first strap 2121 may pass over a first big toe of a wearer and attach to sole portion 2102 at central portion 2151. Furthermore, first strap 2121 may encompass the remaining toes of a wearer between central region 2182 and second fixed end 2183.

In addition, second strap 2122 and third strap 2123 may be disposed to cover an instep of a foot inserted within article of footwear 2100. In particular, second strap 2122 and third strap 2123 may include fixed ends attached to periphery 2150. With this arrangement, second strap 2122 and third strap 2123 may be attached to sole portion 2102 at periphery 2150. Furthermore, second strap 2122 and third strap 2123 may be interwoven at middle portion 2171. With this arrangement, second strap 2122 and third strap 2123 may be disposed to cross over, or be integrally formed with, each other on top of an instep of a foot. Using this configuration, first strap 2121, second strap 2122, and third strap 2123 may hold a toe portion and an instep portion of a foot against sole portion 2102.

Generally, straps portion 2104 and sole portion 2102 may comprise any number of link matrices. In this embodiment, first strap 2121 is comprised of first link matrix 2131. In a similar manner, second strap 2122 and third strap 2123 are composed of second link matrix 2132 and third link matrix 2133, respectively. Finally, sole portion 2102 is comprised of fourth link matrix 2134.

In some embodiments, first link matrix 2131, second link matrix 2132, and third link matrix 2133 may include different types of links. In some cases, first link matrix 2131, second link matrix 2132, and third link matrix 2133 may include links configured with different shapes. Also, first link matrix 2131, second link matrix 2132, and third link matrix 2133 may include links oriented in different directions. Finally, links within first link matrix 2131, second link matrix 2132, and third link matrix 2133 may be disposed in similar or different patterns. Preferably, the configuration of links within first link matrix 2131, second link matrix 2132, and third link matrix 2133 provides a distinct appearance for straps portion 2104 of article of footwear 2100.

In this preferred embodiment, first link matrix 2131, second link matrix 2132 and third link matrix 2133 include links with a substantially similar rectangular prism shape. Furthermore, first link matrix 2131, second link matrix 2132 and third link matrix 2133 include links oriented in a substantially similar latitudinal direction. In addition, links of first link matrix 2131, second link matrix 2132 and third link matrix 2133 are disposed in a herringbone pattern.

In this embodiment, fourth link matrix 2134 may also include links with a generally rectangular prism shape. Additionally, links of fourth link matrix 2134 may be oriented in a generally latitudinal direction. Furthermore, the links of fourth link matrix 2134 may be disposed in a herringbone pattern.

In some cases, fourth link matrix 2134 of sole portion 2102 may be three-dimensional. For example, fourth link matrix 2134 may support an arch of a foot with links configured in a three-dimensional form. Alternatively, fourth link matrix 2134 may be configured with links in a three-dimensional form to provide a wedge heel on article of footwear 2100. In this embodiment, fourth link matrix 2134 has a two-dimensional configuration to provide a relatively flat profile for sole portion 2102.

In some embodiments, different colored links may be combined in link matrices to create aesthetically appealing designs for an article. Generally, links including any number of colors may comprise a link matrix. In this preferred embodiment, fourth link matrix 2134 includes both black and white links. With this arrangement, a first design of black links 2191 and white links 2193 may be visible on upper surface 2191 of sole portion 2104. Furthermore, as seen in FIG. 12, a second design of black links 2191 and white links 2193 substantially similar to the first design may be visible on lower surface 2192 of sole portion 2102. Although this embodiment includes substantially similar designs on both sides of fourth link matrix 2134, in other embodiments fourth link matrix 2134 may comprise links that display substantially different designs on upper surface 2191 and lower surface 2192.

As discussed previously, links in different portions of an article may be constructed from different materials. In this embodiment, first link matrix 2131, second link matrix 2132 and third link matrix 2133 are comprised of links constructed from a softer material such as leather. This may provide straps portion 2104 with flexibility to wrap around a top side of a foot of a wearer. In contrast, fourth link matrix 2134 may be made with a more rigid material such as plastic. Preferably, this provides a durable surface for sole portion 2102 to contact a ground for article of footwear 2100.

Figure 13:
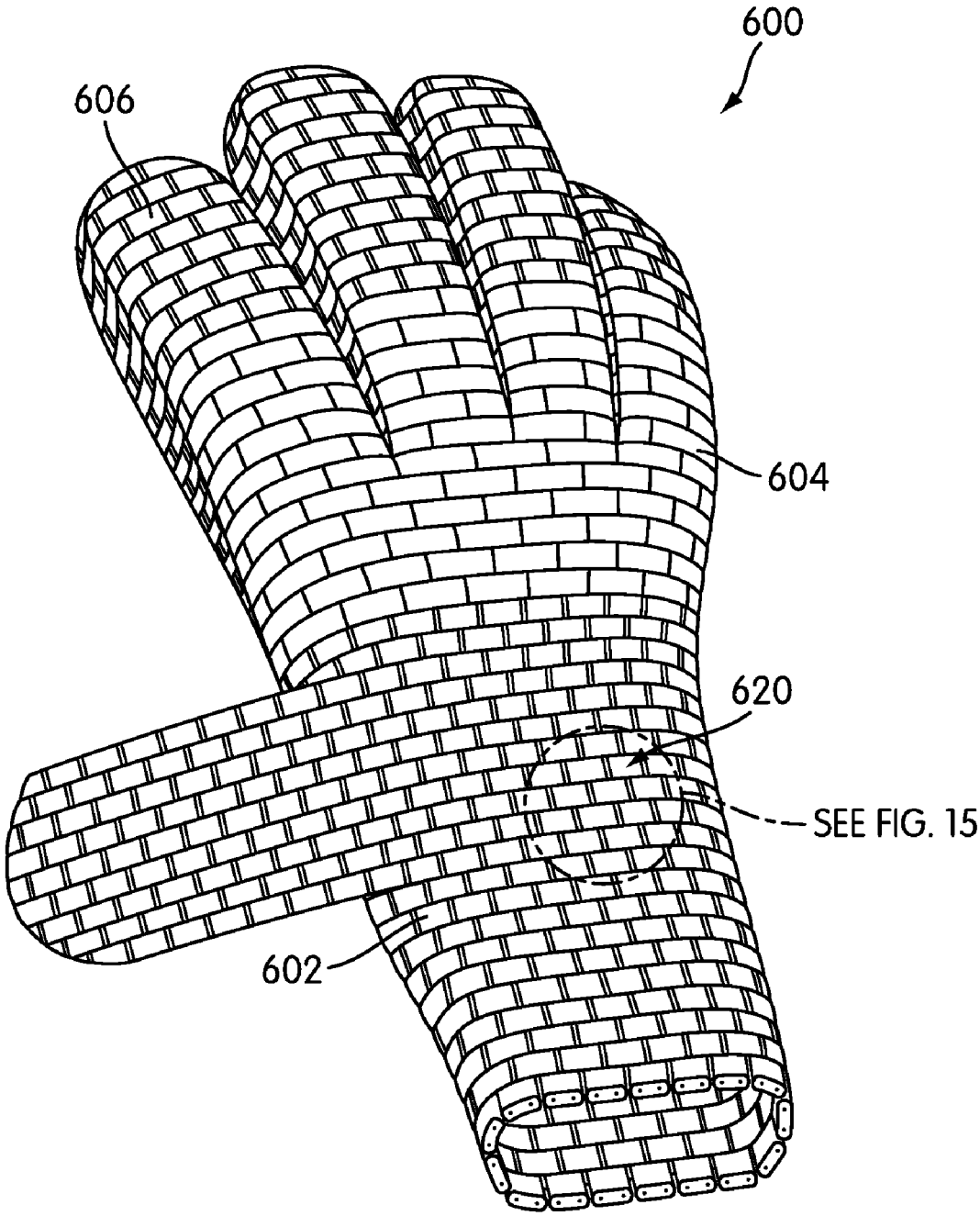
FIG. 13 is an isometric view of a preferred embodiment of an outer portion of a linked article.
Figure 14:
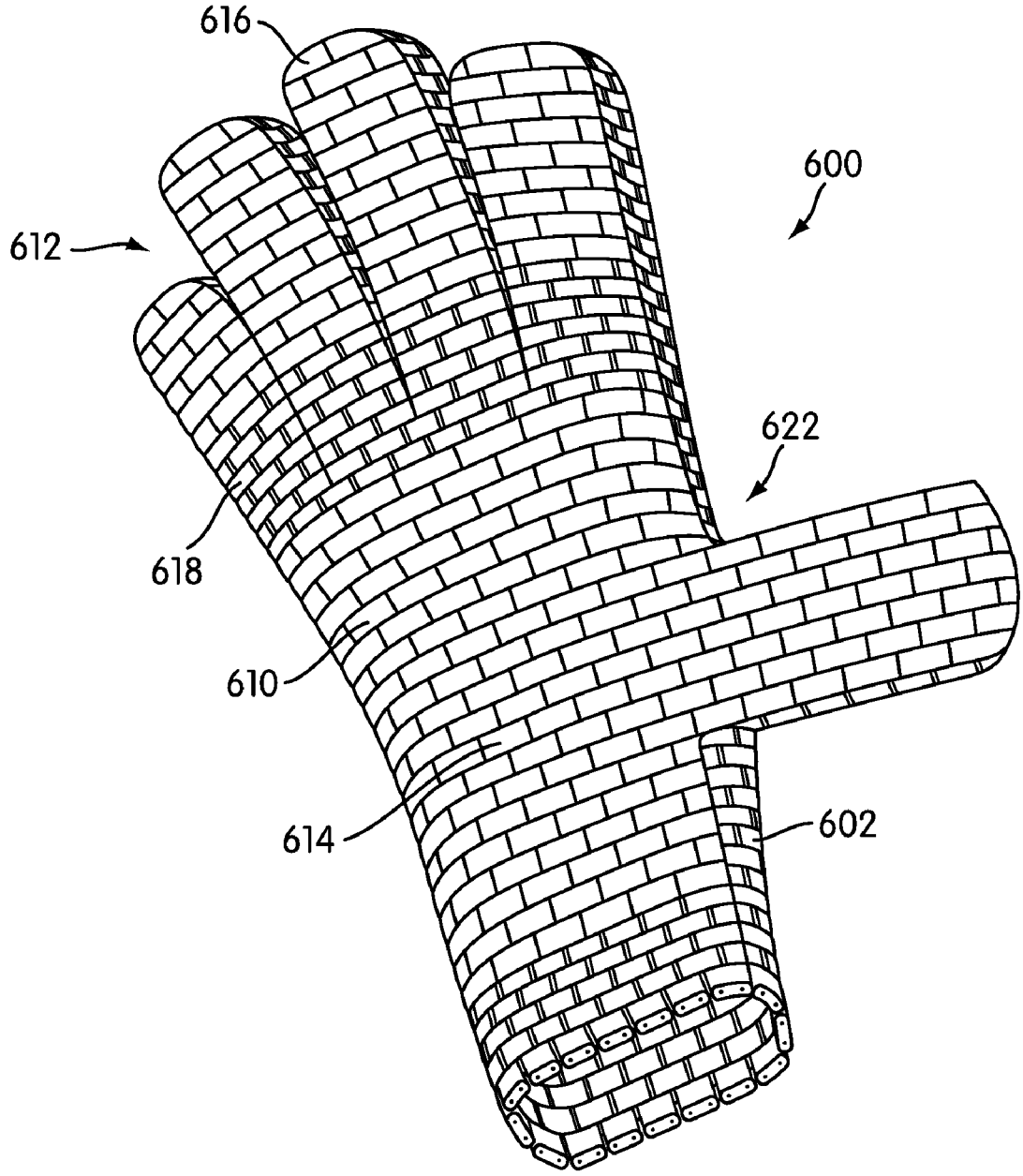
FIG. 14 is an isometric view of a preferred embodiment of a grasping portion of a linked article.
Figure 15:
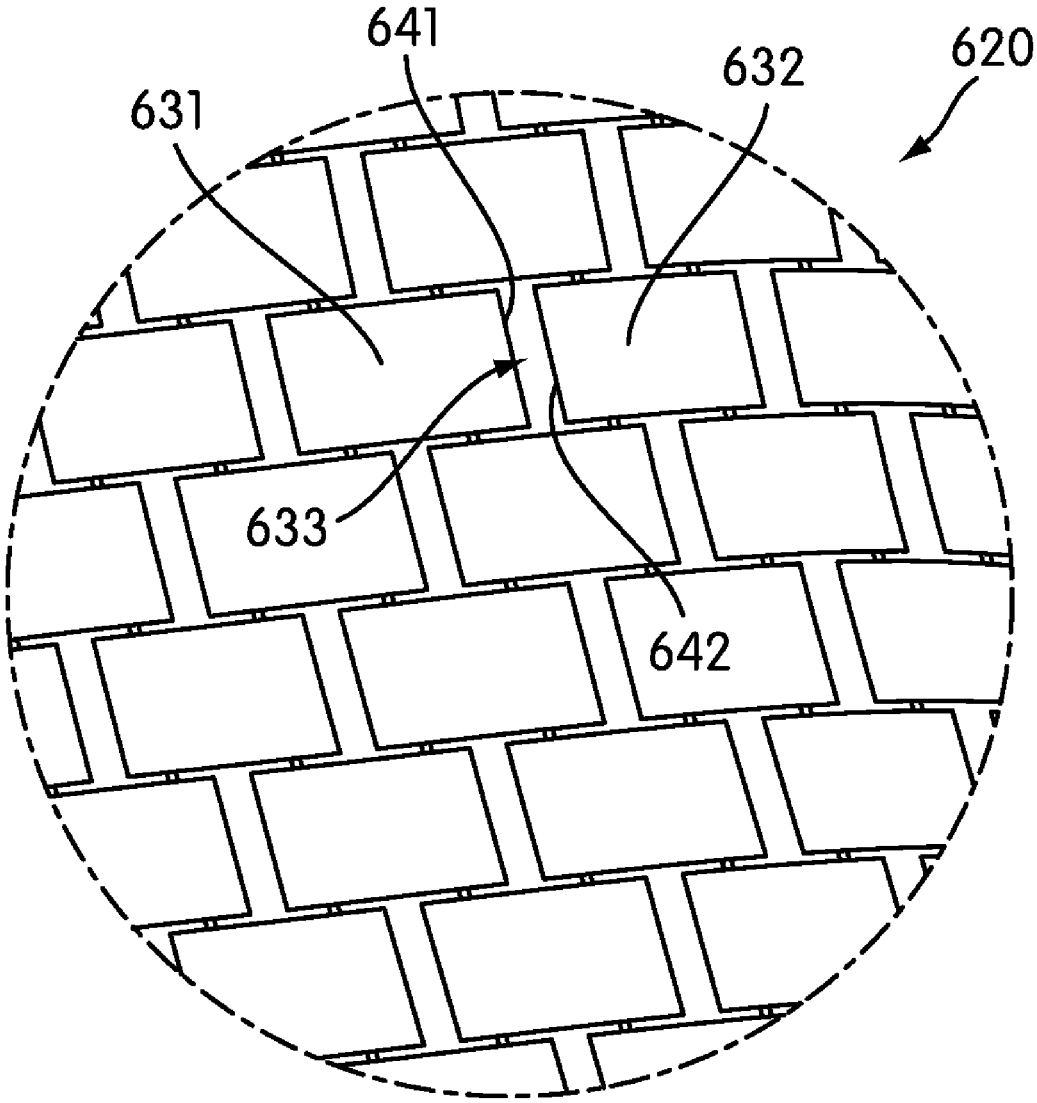
FIG. 15 is an enlarged view of a preferred embodiment of a link matrix with gaps.

FIGS. 13-15 illustrate a preferred embodiment of article 600. In some embodiments, article 600 may be a glove. In this exemplary embodiment, article 600 may be configured to be worn by a goalie in soccer. However, in other embodiments, article 600 could be any type of glove, including, but not limited to, a football glove, a baseball glove, a biking glove, a skiing glove, as well as other types of gloves. Additionally, while a single glove is shown in the current embodiment that is configured to be worn on a right hand, it is intended that the same principles taught in this detailed description could be applied to a second, complementary glove that may be worn on a left hand.

Article 600 preferably comprises outer portion 602, illustrated in FIG. 13. Outer portion 602 may be associated with a top portion of a hand that is disposed opposite of the palm. In some embodiments, outer portion 602 may further include knuckle portion 604 that is associated with the areas surrounding the individual knuckles of a hand. Furthermore, outer portion 602 may be further associated with outer finger tip portions 606 that are configured to cover the tops of each finger of a hand.

Article 600 also preferably comprises inner portion 610 that is disposed opposite of outer portion 602, as seen in FIG. 14. Inner portion 610 may be associated with a palm of a hand, as well as the underside of each finger. In some embodiments, inner portion 610 may be associated with grasping portion 612. The term "grasping portion" refers to portions of a glove that are commonly in contact with a ball during catching and throwing. In this exemplary embodiment, grasping portion 612 includes palm portion 614 as well as inner finger tip portions 616. Furthermore, in this exemplary embodiment, grasping portion 612 does not include lower finger portions 618 that are disposed between palm portion 614 and inner finger tip portions 616. It should be understood that in other embodiments, grasping portion 612 could be associated with different regions of a hand that may make contact with a ball.

In some embodiments, article 600 may be associated with additional provisions. For example, in some cases article 600 could include one or more pads disposed on different portions. In another example, article 600 could include gaps or openings within one or more portions.

Article 600 is preferably made from a plurality of links. In this embodiment, outer portion 602 preferably comprises first link matrix 620. Likewise, grasping portion 612 may comprise second link matrix 622. Although the current embodiment includes two link matrices, in other embodiments additional link matrices could comprise different portions of article 600 as well.

FIG. 15 is an enlarged view of a preferred embodiment of a portion of first link matrix 620. In some embodiments, first link matrix 620 may comprise multiple layers of links. In other embodiments, first link matrix 620 may comprise a single layer of links. In a preferred embodiment, first link matrix 620 may comprise a plurality of links configured in a generally two-dimensional or single layer, arrangement.

Generally, the links comprising first link matrix 620 may have any shape. Examples of possible shapes include, but are not limited to, spheres, cubes, oblate spheroids, tetrahedrons, any regular shapes, any irregular shapes, as well as any other kind of shape. In this exemplary embodiment, first link matrix 620 may comprise links with a generally rectangular prism shape. In particular, the shape of the links comprising first link matrix 620 may be substantially similar to the shape of the links discussed in the previous embodiments.

The links comprising first link matrix 620 may also be configured in any pattern. For example, in some embodiments, links comprising first link matrix 620 may be arranged in a simple grid, so that adjacent rows or columns of links are aligned with one another. In one exemplary embodiment, shown in the Figures, first link matrix 620 may comprise links arranged in a herringbone pattern. In this case, generally oblong links are aligned in an alternating manner. In still other embodiments, the links may be configured in another arrangement.

A link matrix may include provisions for reducing weight of the link matrix. As seen in FIG. 15, first link matrix 620 may include alternating gaps disposed between links. For example, first link 631 and second link 632 of first link matrix 620 may be separated by gap 633. In particular, first end 641 of first link 631 and second end 642 of second link 632 may be separated by gap 633. Preferably, additional gaps are provided between adjacent link ends in first link matrix 620. With this arrangement, gaps in first link matrix 620 may substantially reduce the weight of outer portion 602 and article 600. In some cases, these gaps may also provide for increased airflow to a top portion of a hand.

Generally, gaps within a link matrix may provide increased flexibility to an article. With the inclusion of gaps within a link matrix, highly conformable links may match the contours of the anatomy of a wearer and shift with the movement of a wearer. For example, gaps in first link matrix 620 allow outer portion 602 to match the contours of a top portion of a hand and move as the top portion of the hand moves. This configuration of gaps provides dynamic conformability to first link matrix 620.

The current embodiment illustrates a particular arrangement for a link matrix including gaps. In other embodiments, any arrangements of a link matrix including gaps could be used. Generally, the gaps could be arranged in any pattern within the link matrix. In some cases, the gaps could be arranged regularly. In other cases, the gaps could be arranged irregularly. Furthermore, the gaps could have any shape, including, but not limited to, circular, rectangular, triangular, polygonal, regular or irregular, as well as other types of shapes.

Referring back to FIG. 14, grasping portion 612 preferably comprises second link matrix 622. In this embodiment, second link matrix 622 may also be associated with a plurality of generally rectangular links. Additionally, the links comprising second link matrix 622 may be generally arranged in a herringbone pattern, as discussed in the previous embodiment.

In some embodiments, second link matrix 622 could include gaps. In some cases, these gaps could be arranged in a similar manner to first link matrix 620. In other embodiments, second link matrix 622 may not include gaps. In a preferred embodiment, the links comprising second link matrix 622 may be densely packed without any gaps in order to help increase traction and facilitate increased shock absorption at grasping portion 612.

Generally, the material properties of first link matrix 620 and second link matrix 622 may vary. In some embodiments, first link matrix 620 may consist essentially of a first material. Likewise, second link matrix 622 may consists essentially of a second material. In some cases, the first material may be substantially similar to the second material. In other cases, the first material may be substantially different from the second material. In this exemplary embodiment, the first material may be made of a lightweight polymer to provide a comfortable feel for outer portion 602. Also, in this exemplary embodiment, the second material may be made of rubber to provide increased traction and shock absorption for grasping portion 612.

In some embodiments, knuckle portion 604 may also comprise second link matrix 622. In this case, second link matrix 622 may be made of rubber to provide increased traction and shock absorption. This arrangement may help a goalie to "punch" a ball away from the goal, for example. In other embodiments, however, knuckle portion 604 could also comprise first link matrix 620. In still other embodiments, knuckle portion 604 could comprise a third link matrix. In some cases, the third link matrix could consist essentially of a third material that is different from the first material and the second material. For example, in one alternative embodiment, knuckle portion 604 could comprise a third link matrix consisting essentially of links made of a soft plastic link. This could allow for additional protection to the knuckles of the goalie when punching the ball.

In some embodiments, lower finger portions 618 may comprise first link matrix 620. Since first link matrix 620 includes gaps and is made of a lightweight polymer, in this exemplary embodiment, this arrangement may provide for increased flexibility for the fingers. Furthermore, this arrangement may provide increased airflow to an interior portion of article 600.

Figure 16:
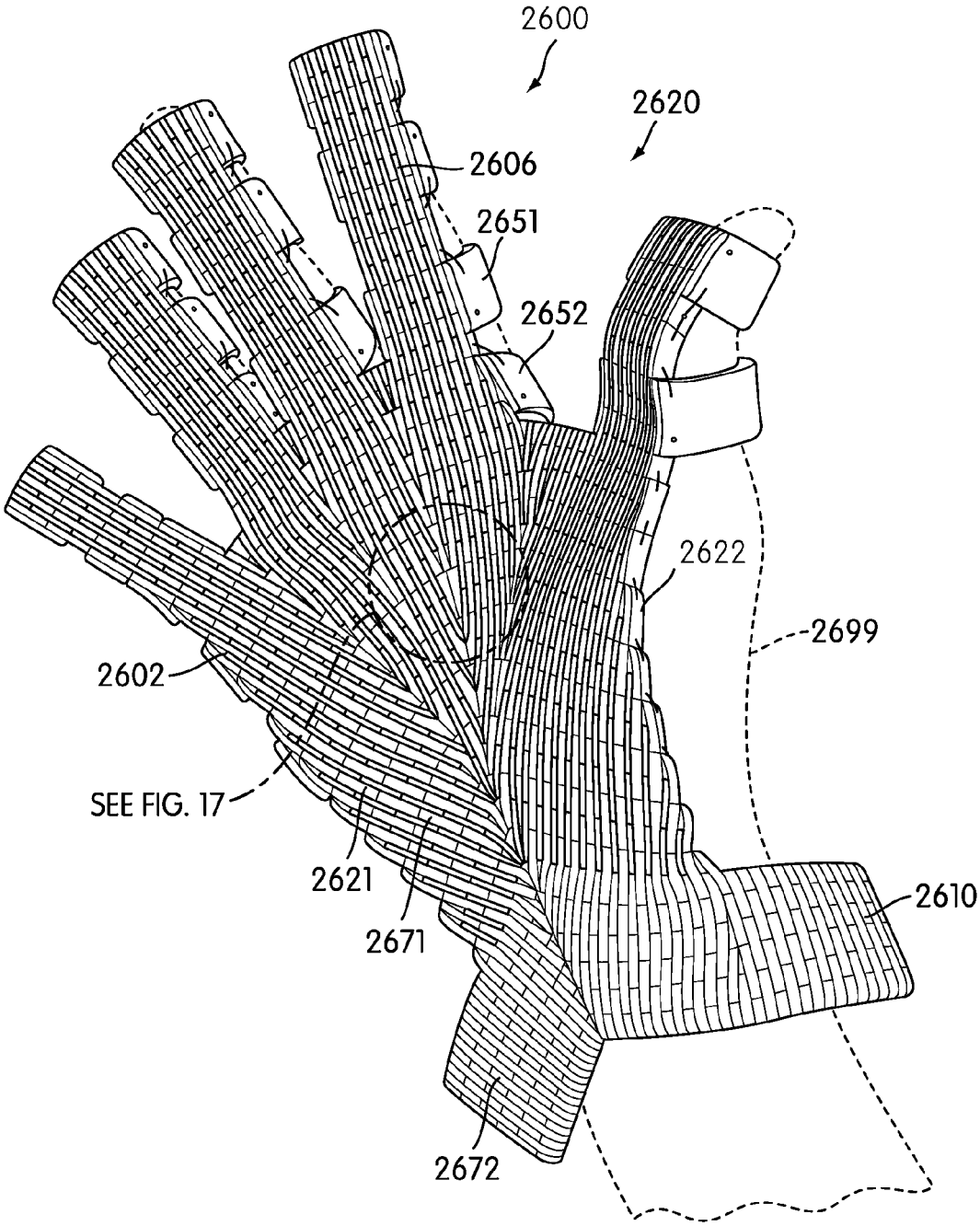
FIG. 16 is a bottom view of a preferred embodiment of a linked article.
Figure 17:
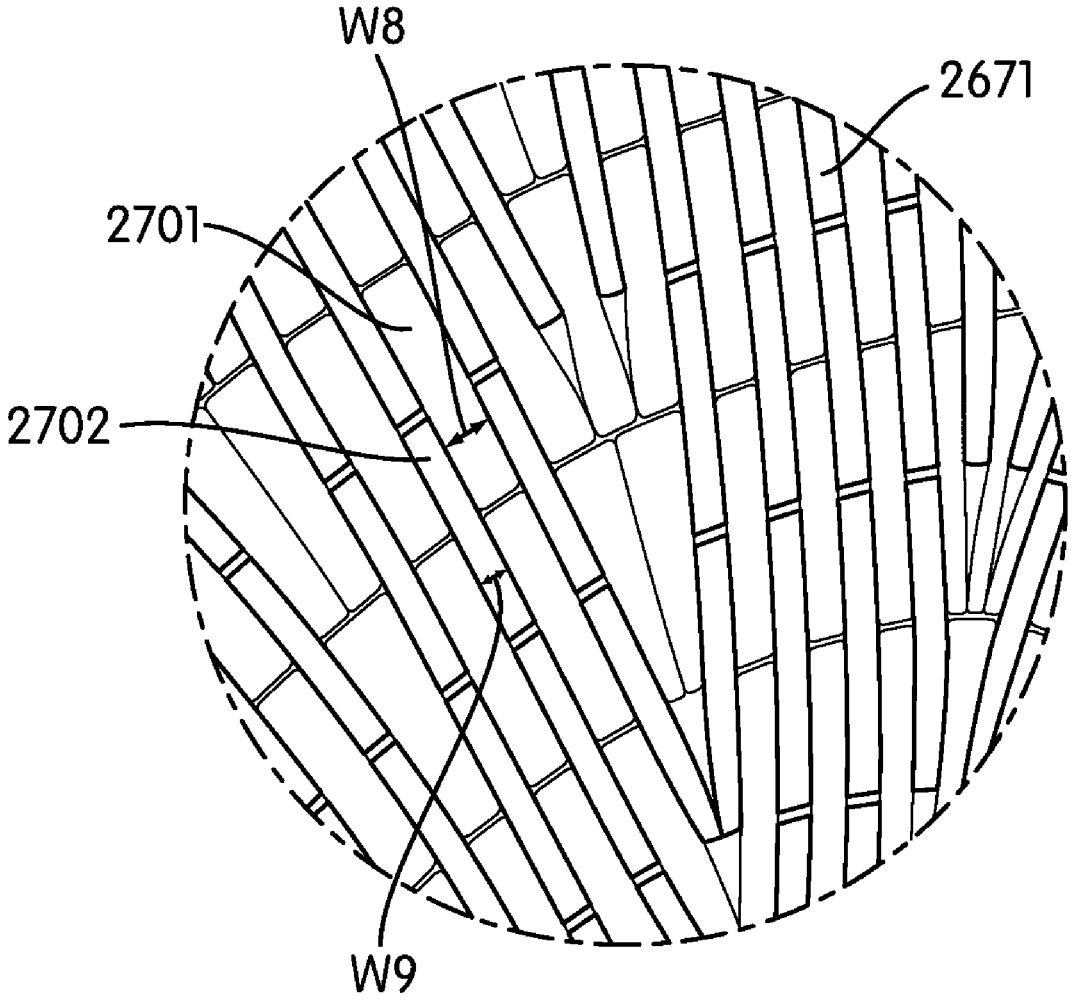
FIG. 17 is a top view of a preferred embodiment of a linked article.
Figure 18:
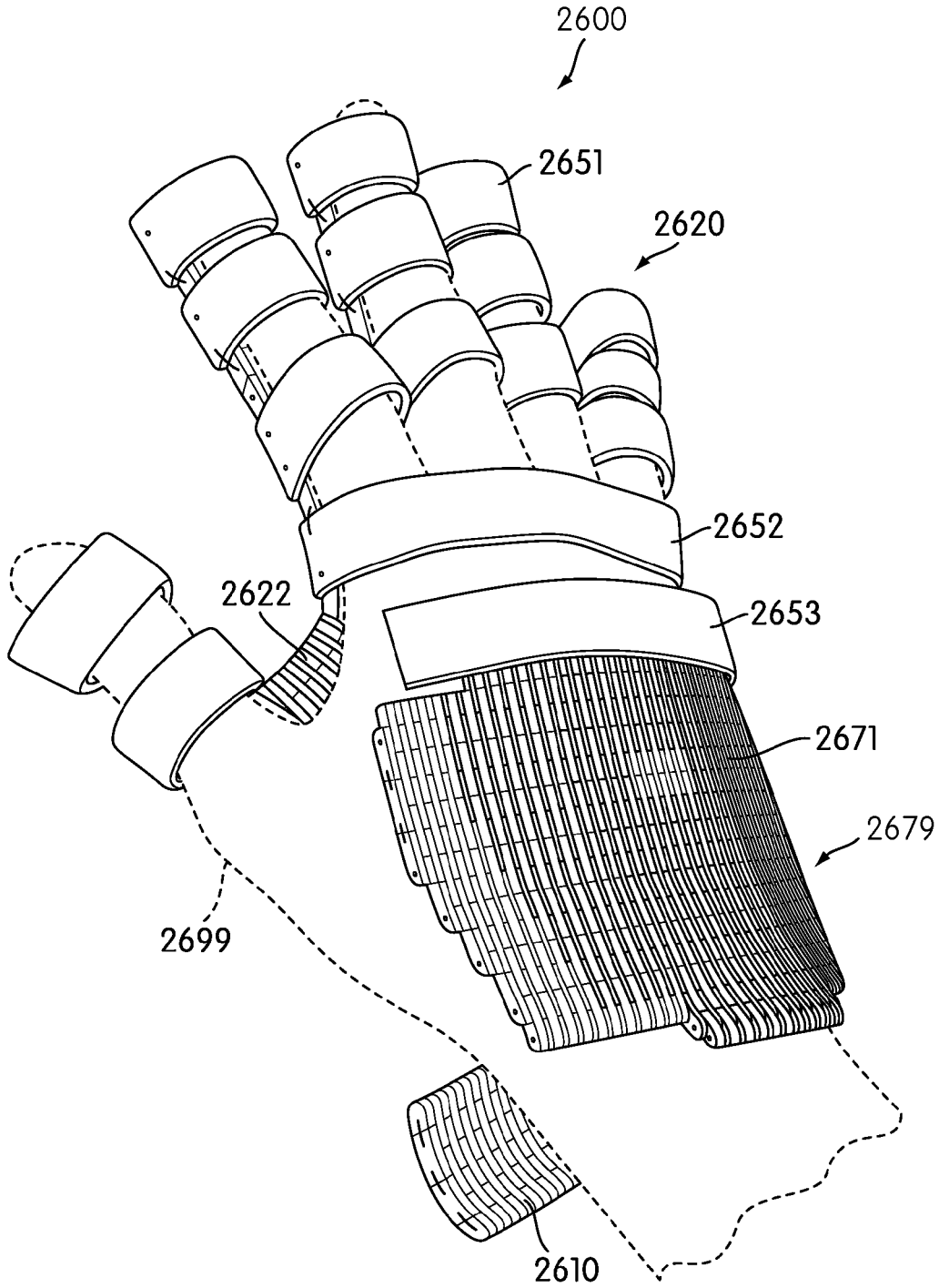
FIG. 18 is an enlarged view of a preferred embodiment of a first link matrix.

In some embodiments, an article may be configured to cover a first portion of a wearer while exposing a second portion of a wearer. FIGS. 16-18 illustrate a preferred embodiment of article 2600. In this exemplary embodiment, article 2600 may be a glove configured to be worn by a goalie in soccer. As with the previous embodiment, however, article 2600 may be configured as another type of glove in other embodiments.

In this embodiment, article 2600 includes inner portion 2602. Preferably, inner portion 2602 is configured to be worn against a bottom portion of hand 2699. Furthermore, inner portion 2602 includes inner finger tip portions 2606 that are configured to cover the inner sides of each finger of hand 2699.

Typically, inner portion 2602 may include upper surface 2622 that may be configured to contact a bottom portion of a hand as seen in FIG. 16. Similarly, inner portion 2602 includes lower surface 2621, disposed opposite of upper surface 2622 that may be disposed outward from a bottom portion of a hand as seen in FIGS. 16 and 18. With this arrangement, upper surface 2622 may be disposed against a bottom portion of a hand while lower surface 2621 may contact other surfaces, including, but not limited to, people, balls, and a ground surface. In a preferred embodiment, lower surface 2621 may provide traction with a ball during throwing and catching.

Inner portion 2602 may also be associated with wrist portion 2610. Wrist portion 2610 may be associated with a wrist of a wearer. Specifically, wrist portion 2610 may be configured to wrap around a portion of a wrist of a wearer. In some cases, wrist portion 2610 may be configured for insertion of a wrist through wrist portion 2610. In other cases, wrist portion 2610 may be associated with a fastening system to fasten wrist portion 2610 to a wrist. For example, in some embodiments, wrist portion 2610 may be associated a hook and loop fastener, such as Velcro® in order to fasten wrist portion 2610.

In some embodiments, article 2600 may include an outer portion 2679. In this embodiment, outer portion 2679 may be a small patch that is configured to cover a top portion of a hand. Generally, the size of outer portion 2679 can vary. In some cases, outer portion 2679 can cover a large portion of a hand. In other cases, outer portion 2679 can cover a small portion of hand 2699. Furthermore, in some cases, the size of outer portion 2679 can be adjusted to increase the overall flexibility of article 2600.

Generally, inner portion 2602 may be affixed to hand 2699 in any manner. In this embodiment, inner portion 2602 may be affixed to hand 2699 using straps 2620 and wrist portion 2610. Straps 2620 include finger straps 2651, knuckle strap 2652 and palm strap 2653. In particular, finger straps 2651 may include multiple straps to attach each finger individually to outer finger tip portion 2606 of inner portion 2602. In addition, knuckle strap 2652 may be configured to wrap around a first knuckle of an index finger, middle finger, ring finger and pinkie finger together. Preferably, knuckle strap 2652 may assist in keeping inner portion 2602 proximate to hand 2699 as the first knuckles bend. Furthermore, palm strap 2653 may be configured to secure a palm of a hand to inner portion 2602. In some cases, palm strap 2653 may also be configured to fix outer portion 2679 in place on a top portion of hand 2699. Finally, wrist portion 2610 may prevent inner portion 2602 from slipping off hand 2699. This configuration of straps 2620 and wrist portion 2610 allow inner portion 2602 to conform to a top portion of hand 2699.

Generally, straps 2620 may be configured in any manner to affix straps 2620 to inner portion 2602. In some cases, straps 2620 may be associated with a lacing system. In other cases, straps 2620 may be associated with a type of fastening system. In still other cases, straps 2620 may include fixed ends attached to inner portion 2602 so that a portion of a hand may be inserted into straps 2620. In this preferred embodiment, finger straps 2651 may be fixed on both ends to inner finger tip portion 2606. In this manner, fingers may be held by finger straps 2651 following insertion of the fingers. Similarly, knuckle strap 2652 may be fixed on both ends to inner portion 2602. With this arrangement, the first knuckles of a hand may be inserted within knuckle strap 2652. Finally, palm strap 2653 and inner portion 2602 may be configured with complementary sides of a hook and loop fastener, such as Velcro® in order to fasten palm strap 2653 to inner portion 2602. This arrangement may hold a palm against inner portion 2602.

Generally, article 2600 may include a plurality of link matrices. In this embodiment, inner portion 2602 comprises first link matrix 2671. Likewise, wrist portion 2610 may comprise second link matrix 2672.

FIG. 17 is an enlarged view of a preferred embodiment of a portion of first link matrix 2671. First link matrix 2671 is configured with a generally two-dimensional arrangement. In other embodiments, first link matrix 2671 may include three-dimensional arrangements of links. In some cases, three-dimensional arrangements of links within first link matrix 2671 may provide additional protection to a top portion of a hand.

Generally, first link matrix 2671 may comprise any number of different types of links. In particular, links within first link matrix 2671 may vary in terms of shape, color, pattern, spacing, size and/or material. In this embodiment, first link matrix 2671 may include two different types of links. Specifically, first link matrix 2671 includes first link set 2701 and second link set 2702.

In this embodiment, first link set 2701 may comprise links of a slightly different size from the links of second link set 2702. In this case, first link set 2701 includes links of a slightly larger size than the links of second link set 2702. In particular, links of first link set 2701 are associated with a width W8 that is substantially larger than width W9 associated with links of second link set 2702. In other embodiments, first link set 2701 and second link set 2702 could comprise links of substantially similar sizes.

Generally, links from first link set 2701 and second link set 2702 may be configured in any arrangement known in the art to create first link matrix 2671. In this embodiment, the links of first link matrix 2671 may be disposed in an alternating herringbone pattern. In particular, the links of first link set 2701 may be aligned in a row interspersed with ends of the links of second link set 2702.

In some cases, links of first link set 2701 may have a different color than the links of second link set 2702. For example, the links of first link set 2701 and the links of second link set 2702 could be colored black and white, respectively.

Preferably, alternating white and black links creates an appealing design for first link matrix 2671.

Generally, first link set 2701 and second link set 2702 may be constructed from any material discussed in this detailed description appropriate for links. In order to provide flexibility, first link set 2701 may be made from a first material. In some cases, the first material may be a light weight polymer. This may allow inner portion 2602 to fit comfortably on a portion of a hand. In addition, second link set 2702 may be made from a second material. In this embodiment, the second material may be rubber to provide increased traction and shock absorption for inner portion 2602. Preferably, this arrangement allows second link set 2702 to protect a portion of a hand. By alternating links of the first material from first link set 2701 with links of the second material from second link set 2702, the material properties of first link matrix 2671 may be fine tuned.

In the current embodiment, second link matrix 2672 may have substantially similar properties to first link matrix 2671. Preferably, links of second link matrix 2672 may have a generally rectangular shape. In addition, the links of second link matrix 2672 may be disposed in a herringbone pattern similar to first link matrix 2671. However, it should be understood than in other embodiments, second link matrix 2672 may comprise links with substantially different sizes, shapes, colors, or other characteristics from the links of first link matrix 2671.

In some embodiments, straps 2620 may be made from link matrices. In this preferred embodiment, straps 2620 are made not made from link matrices. Instead, straps 2620 are constructed from an elastic synthetic material. Preferably, this material allows straps 2620 to stretch and hold a hand against lower surface 2622 of inner portion 2602. However, in other embodiments, straps 2620 could be made from any material, including, but not limited to, leather, plastic, rubber, natural fibers, synthetic fibers as well as other types of materials.

Generally, link matrices may include links with different colors in order to create aesthetically pleasing designs. In particular, link matrices with links of two or more colors can be used to create any decoration, design or other decorative feature. In some cases, different colored links may be configured in an abstract design or realistic design. It is also possible to utilize different colored links to create pictures, indicia or words on an article.

The previous embodiments for an article made of links are only intended to be illustrative. It should be understood that these same principles could be applied to various other types of articles. These principles could be particularly useful with any article where it may be desirable to use two or more different types of links, including links of differing materials.

A linked article may include provisions for customization. Systems and methods for customizing articles, especially articles of footwear, have been previously disclosed by David P. Jones et al. in U.S. patent application Ser. No. 11/612,320, filed Dec. 18, 2006 and entitled "Method of Making an Article of Footwear", the entirety of which is hereby incorporated by reference.

FIGS. 19 through 25 illustrate a method of customizing a linked article. Generally, these principles could be used for customizing any type of article, including, but not limited to, any type of article discussed previously in this detailed description.

Figure 19:
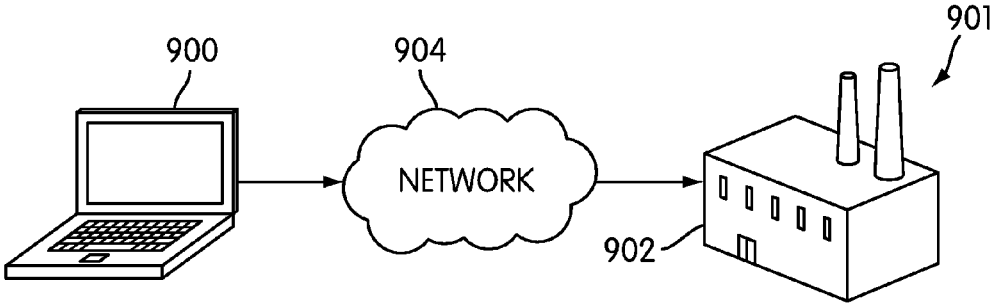
FIG. 19 is a schematic view of a preferred embodiment of a linked article customization system.

FIG. 19 is a schematic diagram of an illustrative embodiment of linked article customization system 901. The term "linked article customization system", as used throughout this detailed description, preferably refers to a system and method for the production of easily customizable portions of an article made from links. In some embodiments, portions of the article may be customized by the manufacturer or a third party designer. In a preferred embodiment, portions of the article may be customized by the party purchasing the article.

In a preferred embodiment, linked article customization system 901 comprises a remote terminal 900 connected to manufacturing system 902 by way of network 904. Generally, remote terminal 900 may be any type of computer, including either a desktop or a laptop computer. In other embodiments, remote terminal 900 may be any type of device that includes a display, a processor, and the ability to transmit and receive data from a remote network. Examples of such devices include, but are not limited to, PDA's, cell phones, as well as other types of devices.

In this embodiment, manufacturing system 902 represents a generalized system for manufacturing linked articles. In FIG. 19, manufacturing system 902 is shown as a single building for illustrative purposes only. In many cases, manufacturing system 902 will comprise many buildings. In some cases, manufacturing system 902 may comprise many buildings that are disposed in different geographic locations. Generally, the term manufacturing system, as used throughout this detailed description and in the claims, may also refer to distributors and/or suppliers. In other words, the term manufacturing system may also apply to various operations, including the operations responsible for parts, labor, and/or retail of the linked article, as well as other related operations.

Preferably, network 904 is configured to relay information between remote terminal 900 and manufacturing system 902. Generally, network 904 may be a system allowing for the exchange of information between remote terminal 900 and manufacturing system 902. Examples of such networks include, but are not limited to, personal area networks, local area networks, wide area networks, client-server networks, peer-to-peer networks, as well as other types of networks. Additionally, the network may support wired transmissions, wireless transmissions, or both wired and wireless transmissions. In some embodiments, network 904 may be a packet-switched communications system. In a preferred embodiment, network 904 may be the Internet.

Figure 20:
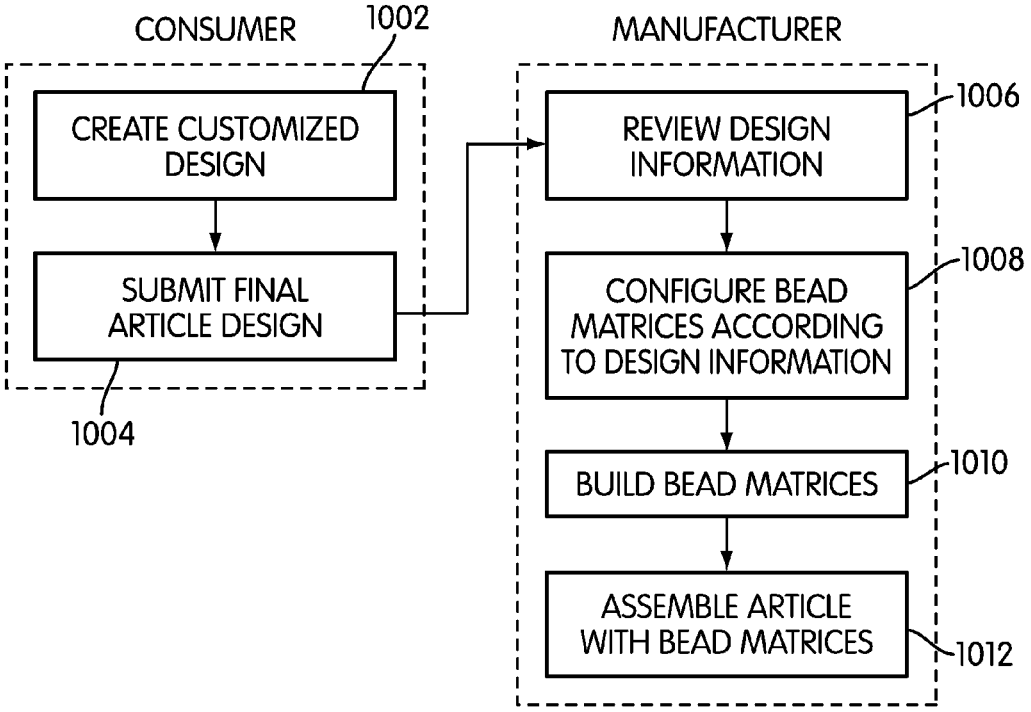
FIG. 20 is a preferred embodiment of a process for customizing a linked article.

Referring to FIG. 20, linked article customization system 901 may be best understood by separating the steps associated with remote terminal 900 and those associated with manufacturing system 902. Preferably, those steps associated with remote terminal 900 are performed on or by remote terminal 900 and those steps associated with manufacturing system 902 are performed on or by manufacturing system 902. However, this is not necessarily the case, and some of the steps associated with remote terminal 900 may be performed on or by manufacturing system 902 or some other resource, and some of the steps associated with manufacturing system 902 may be performed on or by remote terminal 900 or some other resource.

In first step 1002, a customer may access a remote website with remote terminal 900. Preferably, the customer may use the website to design a customized linked article during this step. Here, the term website is used in the most general sense as meaning any collection of data located on a remote server accessible with a web browser of some kind. In many cases, a website may be a collection of web pages found on the World Wide Web. In a preferred embodiment, the term web page may refer to any HTML/XHTML document.

Preferably, manufacturing system 902 includes a server of some type that supports a website with a graphical interface system. This graphical interface system may be preferably used to design a linked article. In some embodiments, the graphical interface system may be a graphical editor of some kind. In a preferred embodiment, the graphical interface system may provide a set of tools that allow the customer to easily apply a custom design to a linked article.

In an alternative embodiment, a website supporting a graphical interface system may be hosted outside of manufacturing system 902. In other words, the website may be owned and run by a third party separate from the manufacturer of the customizable linked articles. Generally, the process of customizing a linked article may proceed as before. In this case, the finalized design information will be processed and sent to the manufacturer by the third party.

Once the customer has finished designing the linked article the finalized design may be submitted to manufacturing system 902 during second step 1004. In some embodiments, the submission may be transferred through the Internet. Following this submission, manufacturing system 902 preferably receives and reviews the customized design during third step 1006.

In fourth step 1008, configurations for one or more link matrices may be determined according to the customized design. In particular, each portion of the customized design may be associated with a link that generally matches the color, shape and/or material composition of indicated by the customized design. Next, during fifth step 1010, one or more link matrices may be built. In some embodiments, this may be achieved using an automated process, such as a link stringing machine. In other embodiments, the linked matrices could be assembled by hand. Finally, once the linked matrices have been made, they may be assembled into a finished article during sixth step 1012. Following this, in some embodiments, the customized linked article may be shipped to a customer or supplied to a retail location for pick-up.

It should be understood that in other embodiments, a linked article could be assembled by a user, rather than by a manufacturer. For example, in another embodiment, a collection of beads, threads and other materials for constructing a beaded article may be assembled into a kit. Preferably, the kit includes a set of instructions for assembling the article. The kit could then be shipped to a customer or to another location for pick-up. At this point, the customer could then assemble the beaded article according to the set of instructions. With this arrangement, a user can be actively involved in the creation of a beaded article.

The following description discusses the details of the steps outlined and briefly described with reference to FIG. 20. In this exemplary embodiment shown in FIGS. 21-25, the linked article to be customized is an article of footwear. However, it should be understood that in other embodiments, these same principles could be used for producing a customized linked article of any type.

Figure 21:
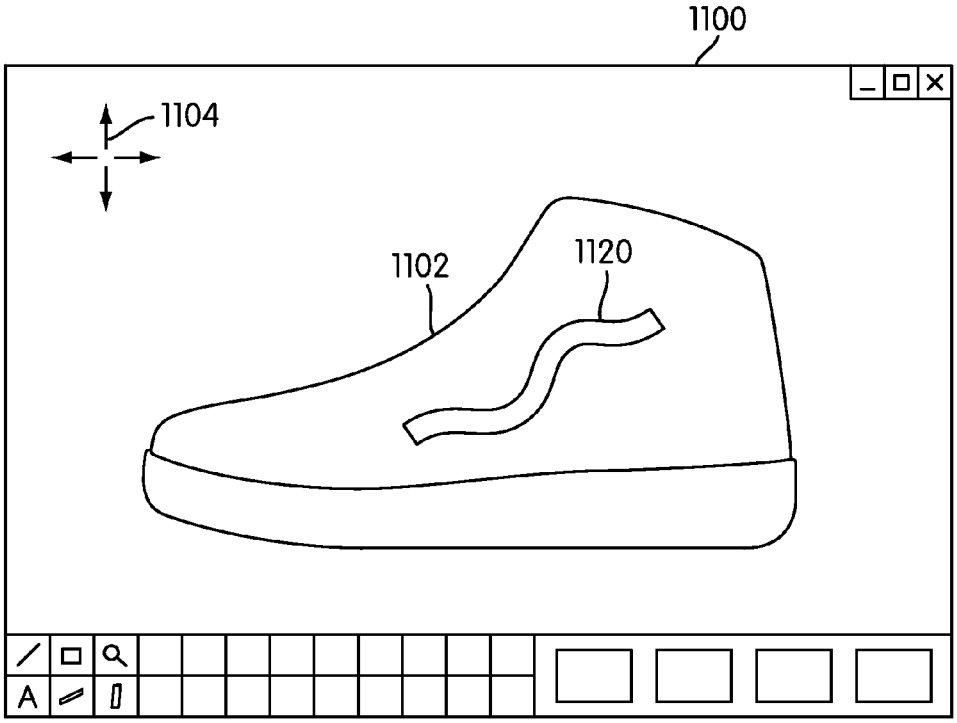
FIG. 21 is a schematic view of a preferred embodiment of a graphical representation system.

Referring to FIG. 21, graphical interface system 1100 preferably includes article representation 1102. The term article representation 1102, as used throughout this specification and in the claims, refers to a three-dimensional embodiment of any linked article within graphical interface system 1100. In particular, the term article representation preferably includes the structural design of the represented article. Additionally, the term article representation preferably includes any other design attributes including, but not limited to, patterns, shapes, designs, colors, images, and any other graphical feature of the outer surface of the represented linked article.

Throughout this specification, it should be understood that not only a single linked article, but a pair of linked articles may be designed with a customization system in some cases. Any designs, tools, or other mechanisms applied to the design of one linked article may likewise be applied to a second, complementary, linked article. The term complimentary, as used throughout this specification and in the claims, refers to the association of a left article with a right article and vice-versa. Also, it should be understood that each article of a pair may be designed independently. In other words, the complementary articles need not include identical designs.

Preferably, graphical interface system 1100 may include provisions for modifying the view of article representation 1102. In some embodiments, this may include a provision for moving article representation 1102 to various regions of graphical interface system 1100. In a preferred embodiment, this may include a provision for rotating article representation 1102 about a set of axes.

In a preferred embodiment, graphical interface system 1100 includes directional tool 1104. In this embodiment, directional tool 1104 is represented by a collection of four arrows. In some embodiments, the graphical representation of directional tool 1104 may be different. In some embodiments, directional tool 1104 may include additional arrows.

Generally, graphical interface system 1100 may include provisions for modifying article representation 1102. In some embodiments, graphical interface system 1100 may include editing tools configured to modify the design of article representation 1102. In a preferred embodiment, graphical interface system 1100 may include tools similar to those found in many graphical editing programs, such as those that draw lines, add text, as well as other features. Examples of various graphical tools are discussed in the customization case.

In some embodiments, graphical interface system 1100 may include provisions for allowing a customer to import various designs or graphics from outside sources. In some embodiments, a customer may attach various media devices to a remote terminal in order to import various graphics or designs to graphical interface system 1100. In a preferred embodiment, a customer may upload pictures or photos from a digital camera or from another source.

In this exemplary embodiment, a customer has applied customized shape 1120 to article representation 1102. In this case, customized shape 1120 is a wavy line. For purposes of clarity, only a single customized shape is shown in the Figures. In other embodiment, additional shapes, text, images or other designs could also be applied to article representation 1102.

Figure 22:
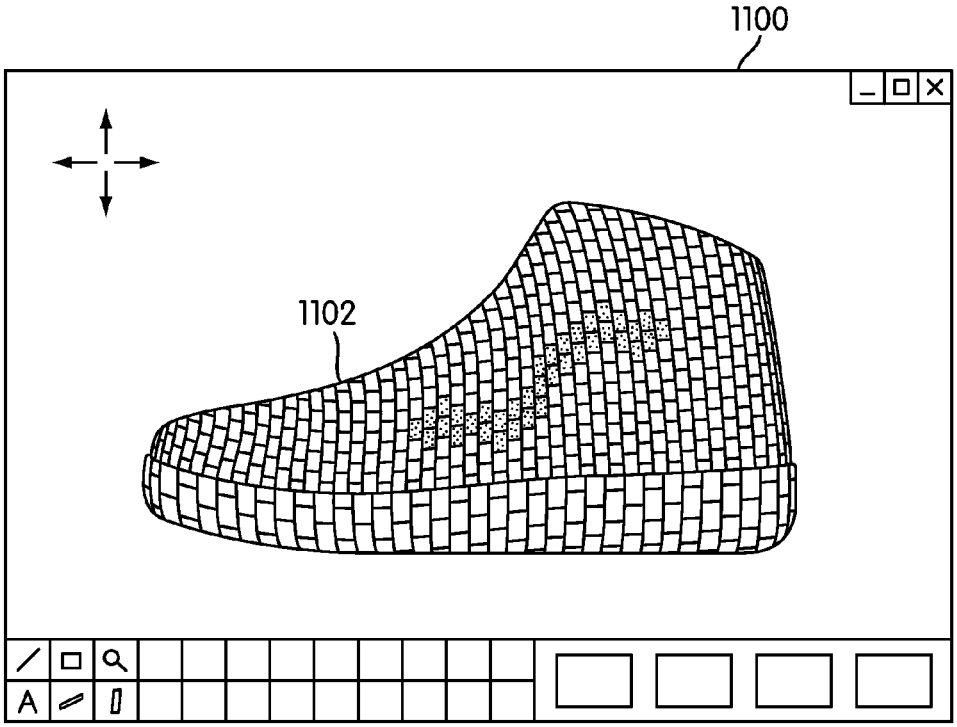
FIG. 22 is a schematic view of a preferred embodiment of a graphical representation system.

Referring to FIG. 22, once a customer has finalized a customized design, the design may be configured for one or more linked matrices. In some cases, a computer may be used to assign each portion of article representation 1102 to a link on a link matrix. During this step, colors, shapes, textures, materials and other customized features may be considered in building a link matrix to match the customized design. In some cases, predefined portions of the article representation may be associated with predefined materials. For example, a sole portion of article representation 1102 could be associated with a link matrix with rubber links to provide support and traction for the completed article of footwear. Likewise, an upper portion of article representation 1102 could be associated with a link matrix with plastic links to provide comfort for a foot.

For purposes of illustration, FIG. 22 illustrates article representation 1102 with a linked configuration. However, in some embodiments, graphical interface 1100 may not display article representation 1102 with a linked configuration. Instead, the steps of assigning portions of the article representation to various link matrices may be accomplished internally by a computer associated with manufacturing system 902.

Once the customized design for an article representation has been associated with one or more configurations of link matrices, the link matrices may be constructed. In some cases, the link matrices may be made using an automated process including one or more machines. In other cases, the link matrices may be built by hand using detailed instructions for stringing together the links and building a link matrix.

Figure 23:
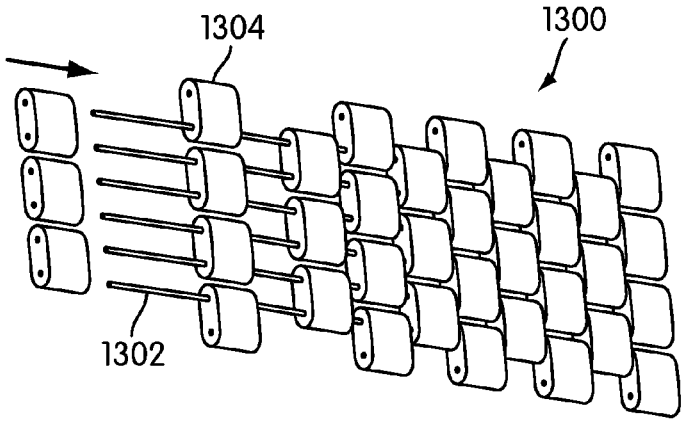
FIG. 23 is a schematic view of a preferred embodiment of a link matrix being assembled.

FIG. 23 is a schematic view of a preferred embodiment of a step of constructing first link matrix 1300. In this case, strands 1302 of a threading material are threaded through a plurality of links 1304. Generally, each of strands 1302 may comprise any number of threads. By including multiple threads in each of strands 1302, strands 1302 may be configured to withstand potential damage to a single thread. In this manner, strands 1302 may be more durable. Each of strands 1302 are further associated with one another to form first link matrix 1300. Generally, each of strands 1302 may be associated with one another to form first link matrix 1300 in any manner known in the art including, but not limited to, knotting, welding, gluing and cementing. Furthermore, remaining ends of each of strands 1302 may be fixed in place by any manner including, but not limited to, knotting, welding, gluing and cementing. In this exemplary embodiment, strands 1302 are threaded through plurality of links 1304 to arrange first link matrix in a herringbone pattern. In other embodiments, however, plurality of links 1304 could be arranged in any other pattern. In a preferred embodiment, loose ends of strands 1302 can be tied-off once link matrix 1300 has been fully assembled.

Figure 24:
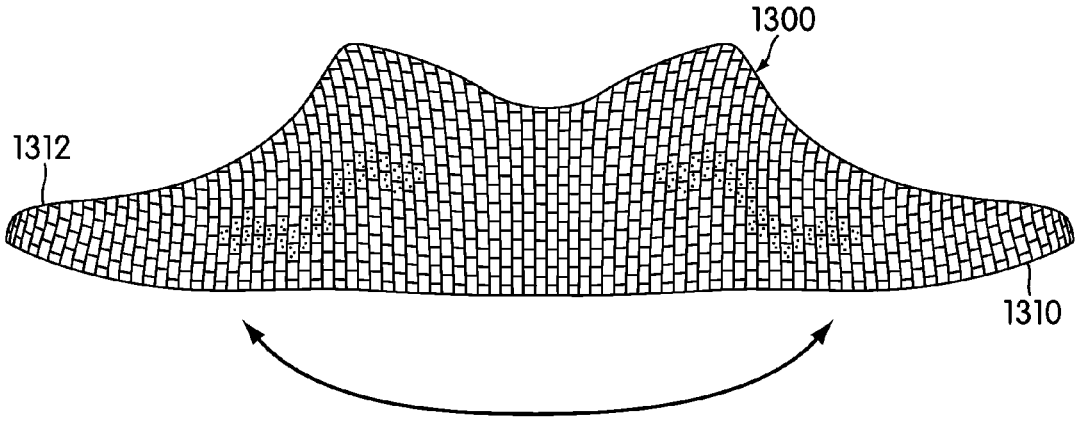
FIG. 24 is a schematic view of a preferred embodiment of an assembled link matrix.

FIG. 24 is a schematic view of a preferred embodiment of first link matrix 1300 that has been constructed using the process discussed in this detailed description. In this embodiment, first link matrix 1300 is configured to be assembled into an upper portion of an article of footwear. In particular, the upper portion may be formed from a single link matrix. In other embodiments, however, an upper portion could be constructed using multiple link matrices.

In this exemplary embodiment, first end 1310 may be associated with second end 1312. Preferably, first end 1310 may be attached to second end 1312. Generally, first end 1310 and second end 1312 could be attached used any method. In some cases, first end 1310 and second end 1312 could be sewn together. In other cases, first end 1310 and second end 1312 could be attached using an adhesive of some kind. With this arrangement, first link matrix 1300 may form an upper portion.

Although the current embodiment illustrates the construction of a linked article from a generally flat link matrix, in other embodiments, a link matrix could be assembled in a three dimensional form.

Figure 25:
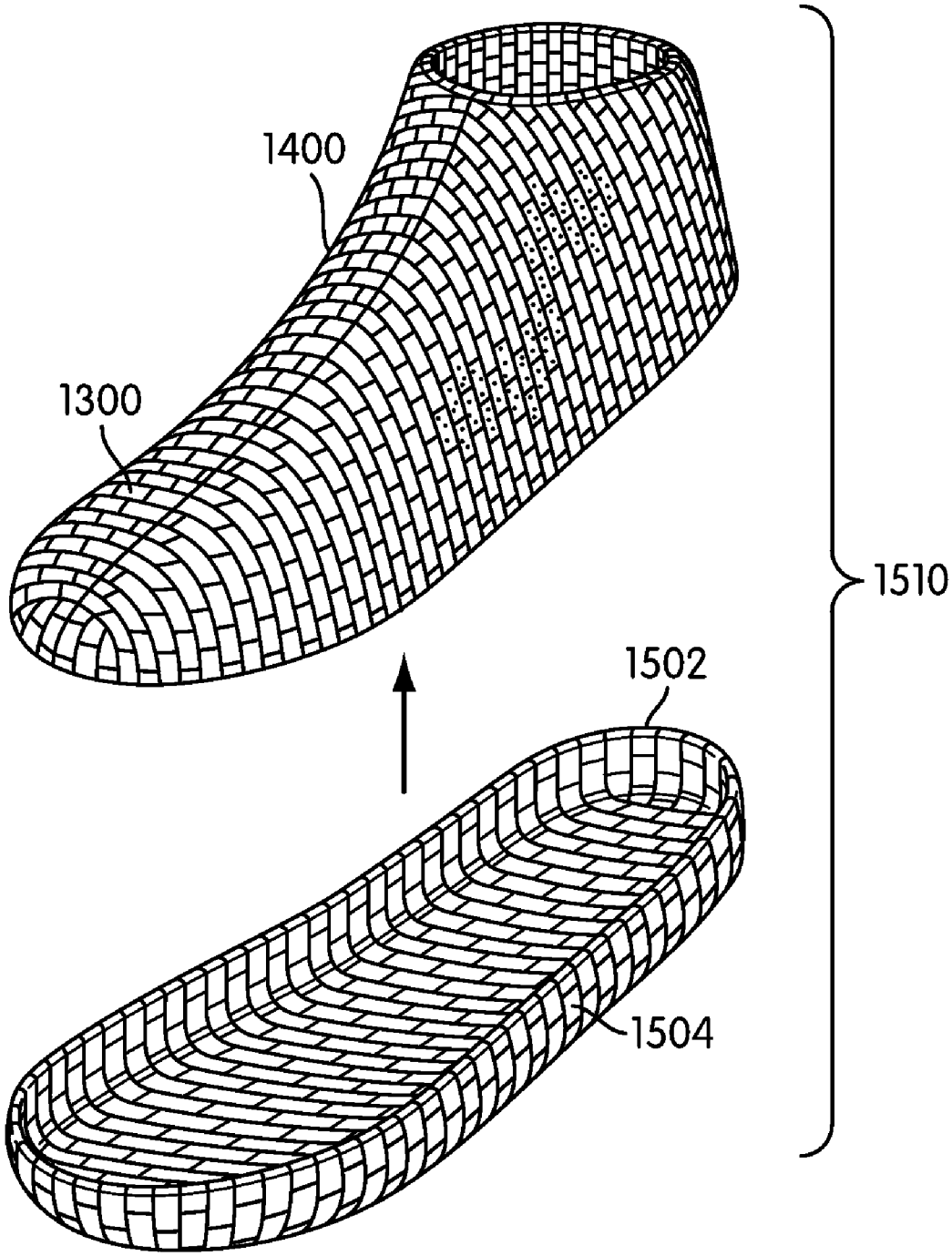
FIG. 25 is a schematic view of a preferred embodiment of the assembly of two linked matrices.

Referring to FIG. 25, after first link matrix 1300 has been sewn together to create upper portion 1400, first link matrix 1300 may be further associated with sole portion 1502 to form article 1510. Preferably, sole portion 1502 comprises second link matrix 1504. In some cases, second link matrix could be constructed using a similar customization process that is used to construct first link matrix 1300. In other cases, second link matrix 1504 could be a pre-designated link matrix that is designed and assembled by the manufacturer.

Linked articles manufactured using a linked article customization system may include portions that are made of essentially different materials. In some embodiments, first link matrix 1300 may consist essentially of a first material. Likewise, second link matrix 1504 may consist essentially of a second material. In this exemplary embodiment, the first material may be different from the second material. With this arrangement, first link matrix 1300 and second link matrix 1504 can provide different support and structure to upper portion 1400 and sole portion 1502, respectively, of article 1510.

It should be understood that in some embodiments, the customization system discussed here could be used with other types of linked articles besides footwear, gloves or other articles that are worn. In some cases, the customization system could be used to create luggage, bags, boxes, as well as other articles that may not be worn.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

I claim:

1. An article of footwear, comprising:

an upper portion of the article consisting essentially of a first link matrix; and a sole portion of the article comprising a second link matrix;

the first link matrix consisting essentially of a first link set formed of links having substantially similar sizes and substantially similar shapes; and the second link matrix comprising a second link set, the second link set comprising a substantial majority of the second link matrix;

wherein the first link set and the second link set are made of different materials.

2. The article according to claim 1, wherein the second link matrix further comprises a third link set.

3. The article according to claim 2, wherein the third link set is made of a different material than the second link set.

4. The article according to claim 1, wherein the first link matrix is associated with a first average rigidity.

5. The article according to claim 4, wherein the second link matrix is associated with a second average rigidity.

6. The article according to claim 5, wherein the first average rigidity is different than the second average rigidity.

7. The article of claim 1, wherein the first link set consists essentially of a first material and the second link set consists essentially of a second material that is different from the first material.

8. The article according to claim 7, wherein the second material provides traction for the article.

9. The article according to claim 1, wherein the size of links comprising the first link matrix is different from the size of links comprising the second link matrix.

10. The article of claim 1, wherein the links of at least one of the first link set and the second link set are arranged in a herringbone pattern.

11. The article of claim 10, wherein the first link set includes a first set of link rows and a second set of link rows, wherein the first set of link rows and the second set of link rows are arranged an alternating fashion to form the herring bone pattern, and wherein the links of the first set of link rows are formed of a first material and the links of the second set of link rows are formed of a second material that is different from the first material.

* * * * *